US009103574B2

(12) United States Patent
Toyoshima et al.

(10) Patent No.: US 9,103,574 B2
(45) Date of Patent: Aug. 11, 2015

(54) AIR CONDITIONER, REFRIGERANT FILLING METHOD OF AIR CONDITIONER, METHOD FOR JUDGING REFRIGERANT FILLING STATE OF AIR CONDITIONER AS WELL AS REFRIGERANT FILLING AND PIPE CLEANING METHOD OF AIR CONDITIONER

(75) Inventors: Masaki Toyoshima, Tokyo (JP); Kousuke Tanaka, Tokyo (JP); Kouji Yamashita, Tokyo (JP); Osamu Morimoto, Tokyo (JP); Fumitake Unezaki, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 924 days.

(21) Appl. No.: 12/915,115

(22) Filed: Oct. 29, 2010

(65) Prior Publication Data

US 2011/0036104 A1 Feb. 17, 2011

Related U.S. Application Data

(62) Division of application No. 11/990,736, filed as application No. PCT/JP2006/310768 on May 30, 2006, now Pat. No. 8,087,258.

(30) Foreign Application Priority Data

Oct. 25, 2005 (JP) ..... 2005-309688
Oct. 25, 2005 (JP) ..... 2005-309955

(51) Int. Cl.
*F25B 41/00* (2006.01)
*F25B 45/00* (2006.01)
*F25B 49/00* (2006.01)

(52) U.S. Cl.
CPC ..... *F25B 45/00* (2013.01); *F25B 49/005* (2013.01); *F25B 2345/001* (2013.01); *F25B 2500/19* (2013.01); *F25B 2600/21* (2013.01); *F25B 2700/04* (2013.01)

(58) Field of Classification Search
CPC .. F25B 45/00; F25B 49/005; F25B 2345/001; F25B 2500/19; F25B 2600/21; F25B 2700/04
USPC ..... 62/77, 149, 160, 174, 185, 203, 430, 62/503, 509, 512
See application file for complete search history.

(56) References Cited

U.S. PATENT DOCUMENTS 4,390,058 A 6/1983 Otake et al.
5,214,918 A 6/1993 Oguni et al.

(Continued)

FOREIGN PATENT DOCUMENTS

JP 60240996 A * 11/1985 ..... F28F 27/00
JP 4-3866 A 1/1992

(Continued)

OTHER PUBLICATIONS

Hiroshi Seshita et al., "Compact Heat Exchanger", The daily Industrial News, 1992, pp. 1-8 with English Abstract.

(Continued)

*Primary Examiner* — Marc Norman
*Assistant Examiner* — Paolo Gonzalez
(74) *Attorney, Agent, or Firm* — Buchanan Ingersoll & Rooney PC

(57) ABSTRACT

An air conditioner includes: a heat source-side unit having a compressor, a heat source-side heat exchanger, a first throttle device and a super-cooling heat exchanger; a load-side unit having a second throttle device and a load-side heat exchanger; a switching device for switching connections of discharge and intake sides of the compressor between the heat source-side unit and the load-side unit; a refrigerant reservoir supplying refrigerant and connected to a refrigerating cycle between the first throttle device of the heat source-side unit and the heat source-side heat exchanger through a refrigerant filling switch valve; and a controller controlling the switching device, the first throttle device, the second throttle device and refrigerant filling switch valve.

5 Claims, 13 Drawing Sheets

101: MEASURING SECTION
102: COMPUTING SECTION
103: CONTROL SECTION
104: STORAGE SECTION
105: COMPARING SECTION
106: JUDGING SECTION
107: ANNOUNCING SECTION

(56) References Cited

U.S. PATENT DOCUMENTS

| | | | | |
|---|---|---|---|---|
| 5,410,887 | A | 5/1995 | Urata et al. | |
| 5,626,026 | A | 5/1997 | Sumida et al. | |
| 5,927,087 | A * | 7/1999 | Ishikawa | 62/174 |
| 5,941,084 | A | 8/1999 | Sumida et al. | |
| 6,032,473 | A | 3/2000 | Morimoto et al. | |
| 6,158,229 | A | 12/2000 | Aizawa | |
| 6,192,696 | B1 | 2/2001 | Shimamoto et al. | |
| 6,247,320 | B1 | 6/2001 | Sumida et al. | |
| 6,571,566 | B1 | 6/2003 | Temple et al. | |
| 6,658,373 | B2 | 12/2003 | Rossi et al. | |
| 7,159,408 | B2 | 1/2007 | Sadegh et al. | |
| 7,558,700 | B2 | 7/2009 | Yamashita et al. | |
| 7,712,319 | B2 | 5/2010 | Braun et al. | |
| 7,752,857 | B2 | 7/2010 | Wakamoto et al. | |
| 2002/0112490 | A1 | 8/2002 | Gong | |
| 2002/0139128 | A1 | 10/2002 | Suzuki et al. | |
| 2005/0229612 | A1 | 10/2005 | Hrejsa et al. | |
| 2005/0284164 | A1 | 12/2005 | Ohta | |

FOREIGN PATENT DOCUMENTS

| | | | |
|---|---|---|---|
| JP | 4-148170 | | 5/1992 |
| JP | 4-151475 | A | 5/1992 |
| JP | 5-99540 | A | 4/1993 |
| JP | 05-106948 | A | 4/1993 |
| JP | 7-190575 | A | 7/1995 |
| JP | 9 113079 | A | 5/1997 |
| JP | 10-089815 | A | 4/1998 |
| JP | 11-270933 | A | 10/1999 |
| JP | 2002-195705 | A | 7/2002 |
| JP | 2004-333121 | A | 11/2004 |
| JP | 2005-098642 | A | 4/2005 |
| JP | 2005-114184 | A | 4/2005 |
| JP | 2005-282885 | A | 10/2005 |
| WO | WO 2005/052467 | A1 | 6/2005 |
| WO | WO 2005/071332 | A1 | 8/2005 |
| WO | WO 2006/090451 | A1 | 8/2006 |

OTHER PUBLICATIONS

G.P. Gaspari, Proc. 5th Int. Heat Transfer Conference, 1974, relevant document showing CISE correlation equation., obtained from the website of The Department of Energy Technology, KTH, Stockholm, Sweden.

International Search Report (PCT/ISA/210).

Extended European Search Report dated Aug. 26, 2010, issued in corresponding EP Application No. 06 74 6996.

Office Action (Notification of Reasons for Refusal) dated Nov. 29, 2010, issued by the Japanese Patent Office in corresponding Japanese Patent Application No. 2007-542234.

Toyoshima et al., U.S. Appl. No. 11/990,736, entitled "Air Conditioner, Refrigerant Filing Method of Air Conditioner, Method for Judging Refrigerant Filing State of Air Conditioner as Well as Refrigerant Filing and Pipe Cleaning Method of Air . . . " filed in the U. S. Patent and Trademark Office on Feb. 21, 2008.

Office Action dated Dec. 10, 2010, issued in corresponding U.S. Appl. No. 11/990,736.

Office Action (Notice of Reasons for Rejection) dated Aug. 7, 2012, issued in corresponding Japanese Patent Application No. 2011-017442, and an English Translation thereof. (4 pages).

* cited by examiner

101: MEASURING SECTION
102: COMPUTING SECTION
103: CONTROL SECTION
104: STORAGE SECTION
105: COMPARING SECTION
106: JUDGING SECTION
107: ANNOUNCING SECTION

101: MEASURING SECTION
102: COMPUTING SECTION
103: CONTROL SECTION
104: STORAGE SECTION
105: COMPARING SECTION
106: JUDGING SECTION
107: ANNOUNCING SECTION

101: MEASURING SECTION
102: COMPUTING SECTION
103: CONTROL SECTION
104: STORAGE SECTION
105: COMPARING SECTION
106: JUDGING SECTION
107: ANNOUNCING SECTION

101: MEASURING SECTION
102: COMPUTING SECTION
103: CONTROL SECTION
104: STORAGE SECTION
105: COMPARING SECTION
106: JUDGING SECTION
107: ANNOUNCING SECTION

101: MEASURING SECTION
102: COMPUTING SECTION
103: CONTROL SECTION
104: STORAGE SECTION
105: COMPARING SECTION
106: JUDGING SECTION
107: ANNOUNCING SECTION

101: MEASURING SECTION
102: COMPUTING SECTION
103: CONTROL SECTION
104: STORAGE SECTION
105: COMPARING SECTION
106: JUDGING SECTION
107: ANNOUNCING SECTION

101: MEASURING SECTION
102: COMPUTING SECTION
103: CONTROL SECTION
104: STORAGE SECTION
105: COMPARING SECTION
106: JUDGING SECTION
107: ANNOUNCING SECTION

AIR CONDITIONER, REFRIGERANT FILLING METHOD OF AIR CONDITIONER, METHOD FOR JUDGING REFRIGERANT FILLING STATE OF AIR CONDITIONER AS WELL AS REFRIGERANT FILLING AND PIPE CLEANING METHOD OF AIR CONDITIONER

TECHNICAL FIELD

The present invention relates to an air conditioner and more specifically to a technology for judging an adequate refrigerant filling amount from operation characteristics detected from the air conditioner and for automatically filling refrigerant to the air conditioner in a process of filling the refrigerant after installing the machine or during maintenance thereof.

BACKGROUND ART

Hitherto, there have been already proposed various methods for filling refrigerant of an air conditioner. Then, basic technologies of the refrigerant filling methods and an adequate refrigerant filling amount judging technique will be described below.

As a prior art refrigerant filling method, there has been proposed a method of automatically filling refrigerant by connecting a refrigerant cylinder and a refrigerant circuit via an electromagnetic valve and by automatically opening/closing the electromagnetic valve by judging a refrigerant filling rate from outlet super-cooling degree of a liquid receiver (Patent Document 1: Japanese Patent Application Laid-open No. 2005-114184, for example).

Furthermore, as the prior art adequate refrigerant filling amount judging method, there has been proposed a method by finding a relationship of indoor and outdoor temperatures of an air conditioner, intake super-heating degree or discharge super-heating degree and a refrigerant filling rate in advance for the machine and storing them (Patent Document 2: Japanese Patent Application Laid-open No. Hei. 04-003866, for example). There has been also provided a method by finding relational expressions between indoor and outdoor temperatures, intake and discharge super-heating degrees, a refrigerant charging rate and a ratio of length of connected pipes in advance, and calculating the refrigerant charging rate and the ratio of length of connected pipes from measured values of the indoor and outdoor temperatures and calculated values of the intake and discharge super-heating degrees to judge a refrigerant charging amount from the refrigerant charging rate (Patent Document 3: Japanese Patent Application Laid-open No. Hei. 04-151475, for example). There has been also provided a method by deciding target super-cooling degree from atmospheric temperature and comparing it with super-cooling degree during operation of the refrigerating cycle to fill refrigerant during the time when the super-cooling degree is lower than the target super-cooling degree and to stop filling refrigerant at a point of time when the super-cooling degree coincides with the target super-cooling degree (Patent Document 4: Japanese Patent Application Laid-open No. Hei. 05-099540, for example).

Patent Document 1: Japanese Patent Application Laid-open No. 2005-114184

Patent Document 2: Japanese Patent Application Laid-open No. Hei. 04-003866

Patent Document 3: Japanese Patent Application Laid-open No. Hei. 04-151475

Patent Document 4: Japanese Patent Application Laid-open No. Hei. 05-099540

Non-Patent Document 1: "Compact Heat Exchanger" by Hiroshi Seshita and Masao Fujii, The Daily Industrial News, 1992

Non-Patent Document 2: "Proc. 5th Int. Heat Transfer Conference" by G. P. Gaspari, 1974

DISCLOSURE OF INVENTION

Problems to be Solved by the Invention

However, the prior art arrangements have had a problem that it accommodates only a cooling operation with one condensing heat exchanger and that it is unable to adequately judge a refrigerant filling amount when a heating operation is carried out or when a plurality of condensing heat exchangers exist.

Still more, the prior art arrangements have had a problem that it takes a time to check and input length of refrigerant pipes when installing the machine, because the prior art arrangement requires inputting information such as the length of the refrigerant pipes after installing the machine. There has been also a problem that it is unable to obtain correct length of the refrigerant pipes because the refrigerant pipes are buried within a building in a case of replacing an air conditioner by utilizing existing pipes again.

There has been also a problem that it is unable to detect a refrigerant filling amount even if a cycle simulation is implemented from information on temperature and pressure. That is because in a type of machine having a device for reserving extra refrigerant such as an accumulator and a receiver as a component thereof, the temperature and pressure of the refrigerating cycle do not change even if a filled refrigerant amount changes.

Still more, there has been a problem that because liquid refrigerant may remain in the accumulator at a start of the machine or during filling of refrigerant, it takes a lot of time and workability drops until a time when it becomes possible to judge a correct refrigerant amount by evaporating the liquid refrigerant existing within the accumulator. Furthermore, there has been a possibility of erroneously judging the refrigerant amount by making the judgment without knowing whether or not the liquid refrigerant remains within the accumulator.

Furthermore, it has been difficult to carry out the prior art refrigerant filling amount judging method of the air conditioner, because the relational expressions must be obtained individually for various combinations of outdoor and indoor machines in advance and testing load becomes enormous for an air conditioner system having a large number of combinations. Still more, there has been a problem that it takes a lot of labor every time when a new type of machine is developed because the relational expression depends on the type of machine and cannot be applied to other types of machine.

In order to deal with these problems, the present invention adopts the following arrangements.

Means for Solving the Problems

The invention allows a condenser liquid phase area ratio to be calculated, not based on a single operation state value such as super-heating degree or super-cooling degree of an air conditioner, but based on a plurality of parameters.

The invention also allows a refrigerant filling state during refrigerating cycle to be judged based on the liquid phase area ratio.

The air conditioner of the invention comprises:

a refrigerating cycle formed by connecting a compressor, at least one high pressure-side heat exchanger, a throttle device corresponding to each high pressure-side heat exchanger and at least one low pressure-side heat exchanger with pipes, for circulating high-temperature and high-pressure refrigerant within the high pressure-side heat exchanger and low temperature and low pressure refrigerant within the low pressure-side heat exchanger;

a fluid sending section for letting fluid flow through the outside of the high pressure-side heat exchanger to cause heat exchange between the refrigerant within the high pressure-side heat exchanger and the fluid;

a high-pressure refrigerant temperature detecting section or a high pressure detecting section for detecting condensation temperature or temperature on the way of cooling of the refrigerant within the high pressure-side heat exchanger;

a high pressure-side heat exchanger outlet side refrigerant temperature detecting section for detecting temperature of the refrigerant on the outlet side of the high pressure-side heat exchanger;

a fluid temperature detecting section for detecting the temperature of the fluid circulating through the outside of the high pressure-side heat exchanger;

a control section for controlling the refrigerating cycle based on each detected value detected by each detecting section; and a computing section for computing a condenser liquid phase area ratio related to an amount of a liquid phase portion of the refrigerant within the high pressure-side heat exchanger obtained based on each detected value detected by each detecting section.

It is noted that the condenser liquid phase area ratio may be computed on the basis of refrigerant condensation temperature of the high pressure-side heat exchanger, outlet super-cooling degree of the high pressure-side heat exchanger, intake fluid temperature of the high pressure-side heat exchanger, a difference of enthalpy of inlet and outlet of the high pressure-side heat exchanger and liquid specific heat at constant pressure of the refrigerant solution of the outlet of the high pressure-side heat exchanger.

The air conditioner further comprises a judging section for judging a refrigerant filled state within the refrigerating cycle based on a comparison of a value calculated by the computing section with a predetermined threshold value.

The predetermined threshold value may be a theoretical value calculated based on the condensation temperature and liquid density of the high pressure-side heat exchanger as well as evaporation temperature of the low pressure-side heat exchanger.

The predetermined threshold value is a target threshold value corresponding to the structure of the air conditioner, so that the computing section preferably has threshold value changing means for changing the target threshold value corresponding to the structure of the air conditioner. It is noted that the threshold value changing means is threshold value deciding means for deciding the threshold value corresponding to a total heat exchange capacity or total volume of the high pressure-side heat exchanger or to a length of the pipes.

In the air conditioner having the plurality of high pressure-side heat exchangers, the condenser liquid phase area ratio may be calculated as a weighted mean of the respective values in a plurality of high pressure-side heat exchangers.

A refrigerant filling state judging method in a refrigerating cycle by connecting a compressor, a high pressure-side heat exchanger, a throttle device and a low pressure-side heat exchanger with pipes to circulate high-temperature and high-pressure refrigerant within the high pressure-side heat exchanger and low temperature and low pressure refrigerant within the low pressure-side heat exchanger, according to the invention, comprises steps of:

calculating a condenser liquid phase area ratio that is a value related to an amount of liquid phase portion of the refrigerant within the high pressure-side heat exchanger from refrigerant condensation temperature of the high pressure-side heat exchanger, outlet super-cooling degree of the high pressure-side heat exchanger, intake fluid temperature of the high pressure-side heat exchanger, a difference of enthalpy of inlet and outlet of the high pressure-side heat exchanger and liquid specific heat at constant pressure of the refrigerant solution of the outlet of the high pressure-side heat exchanger; and comparing the ratio with a predetermined value to judge a refrigerant filling state within the refrigerating cycle.

A refrigerant filling method of an air conditioner comprising a heat source-side unit having a compressor, a heat source-side heat exchanger, a throttle device and an accumulator, a load-side unit having a throttle device and a load-side heat exchanger and a switching valve for switching connections of the discharge and intake sides of the compressor between the heat source-side unit and the load-side unit, according to the invention, comprises a selecting step of selecting a cooling or heating operation after constructing the refrigerant circuit by connecting the respective units by pipes;

a drying step of evaporating liquid refrigerant within the accumulator by starting the compressor; and a refrigerant filling step of starting filling of refrigerant after evaporating the liquid refrigerant within the accumulator.

Effects of the Invention

Because the condenser liquid phase area ratio that becomes an index for judging the refrigerant filling state is found on the basis of not a value of single operation state such as super-heating degree or super-cooling degree of the air conditioner but of the plurality of parameters, it is possible to judge the refrigerant filling state stably and accurately even if the environmental conditions such as the outside air temperature change.

Still more, it becomes possible to judge the refrigerant filling state accurately in the heating operation in which the plurality of condensers having different capacities exist and to automate the refrigerant filling process by calculating a weighted mean of the liquid phase area ratio corresponding to a total heat exchanging capacity or total volume of the condensers and by changing the threshold value for judgment corresponding to the total volume.

Furthermore, according to the invention, it is possible to judge the refrigerant filing state accurately without being influenced by the accumulator and the liquid reservoir even in the circuit structure having the accumulator and the liquid reservoir, by operating so as to collect the refrigerant to the condenser and the extension pipe.

Furthermore, according to the invention, it is possible to judge the refrigerant filing state accurately without being influenced by the refrigerant amount within the accumulator because the liquid refrigerant does not remain in the liquid reservoir such as the accumulator and the inside of the accumulator becomes always gaseous by arranging so that the refrigerant is filled into the main circuit in the gaseous state via the heat exchanger when filling the refrigerant.

Still more, according to the invention, even if the plurality of machines having different capacity is connected to the side of the condenser, it becomes possible to detect the refrigerant amount accurately by calculating the condenser liquid phase area ratio from the weighted mean corresponding to the ratio of the respective capacities.

Thus, the air conditioner of the invention can fill the adequate refrigerant amount corresponding to a machine of object by adopting the structures described above because it can judge the refrigerant filling state of the air conditioner accurately regardless of the environmental and installation conditions.

REFERENCE NUMERALS

Figure 1:
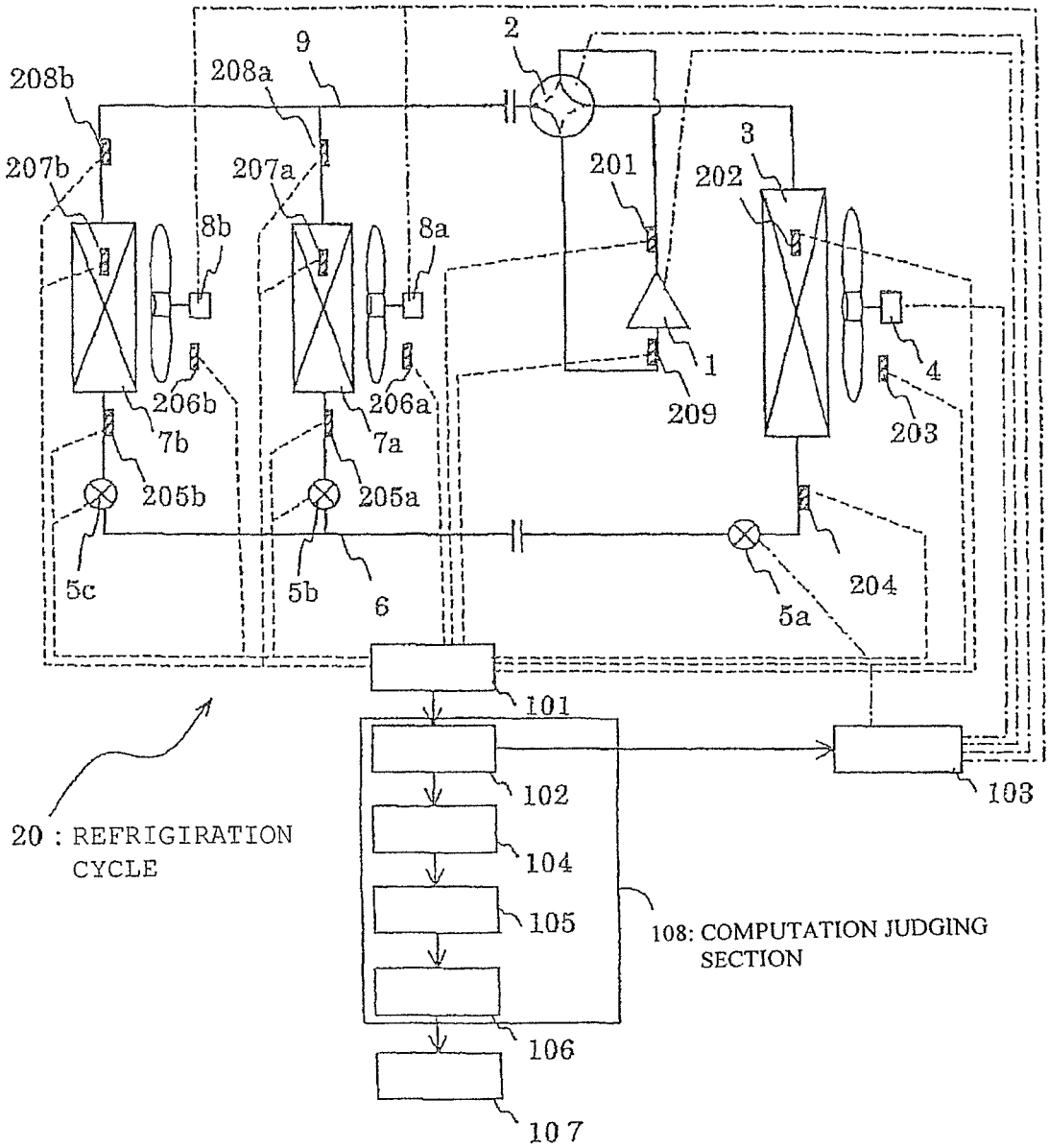
FIG. 1 is a diagram showing a structure of an air conditioner of a first embodiment.

1 compressor
2 four-way valve
3 outdoor heat exchanger
4 outdoor blower
5*a*, 5*a*, 5*b*, 5*c* throttle device
6 connection pipe
7*a*, 7*b* indoor heat exchanger
8 indoor blower
9 connection pipe
10 accumulator
11 receiver
20 refrigerating cycle
201 compressor outlet temperature sensor
202 outdoor machine two-phase temperature sensor
203 outdoor temperature sensor
204 outdoor heat exchanger outlet temperature sensor
205*a*, 205*b* indoor heat exchanger inlet temperature sensor
206*a*, 206*b* indoor machine intake temperature sensor
207*a*, 207*b* indoor machine two-phase temperature sensors
208*a* and 208*b* indoor machine outlet temperature sensor
209 compressor intake temperature sensor
101 measuring section
102 computing section
103 control section
104 storage section
105 comparing section
106 judging section
107 announcing section
108 Computation judging section
501 compressor
502 four-way valve 502
503 heat source-side heat exchanger
504 liquid-side ball valve
505*a*, 505*b*, 505*c*, 505*d*, 505*e*, 505*f* pressure regulating valve (throttle valve)
506*a*, 506*b* load-side heat exchanger
507 gas-side ball valve
508 accumulator
509 super-cooling heat exchanger
510*a*, 510*b*, 510*c* fan
511 liquid pipe
512 gas pipe
515*a*, 515*b*, 515*c*, 515*d*, 515*e* electromagnetic valve
516*a*, 516*b* pressure sensor
517*a*, 517*b*, 517*c* check valve
518 flow regulating valve
520*a*, 520*b*, 520*c* temperature sensor
521 discharge temperature sensor
522 intake temperature sensor
523*a*, 523*b*, 523*c* heat exchange temperature sensor
524*a*, 524*b*, 524*c* heat exchange outlet temperature sensor
525*a*, 525*b* heat exchange inlet temperature sensor
526 refrigerant heat exchanger outlet temperature sensor
530 refrigerant cylinder
531 refrigerant heat exchanger

BEST MODE FOR CARRYING OUT THE INVENTION

First Embodiment

Figure 2:
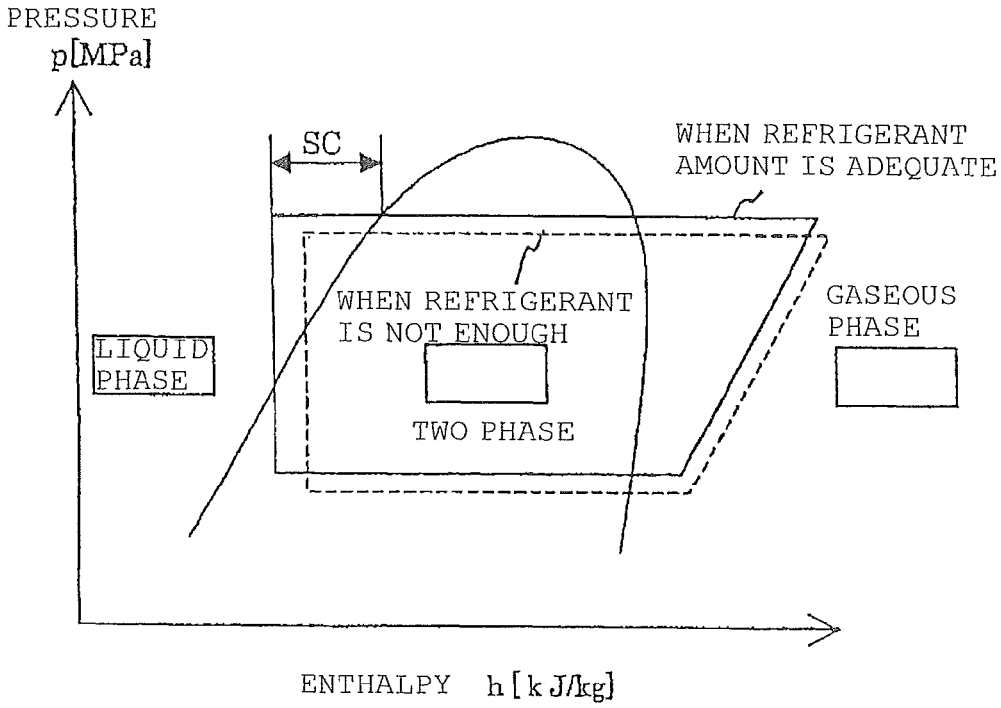
FIG. 2 is a p-h diagram of the air conditioner when refrigerant is insufficient.
Figure 3:
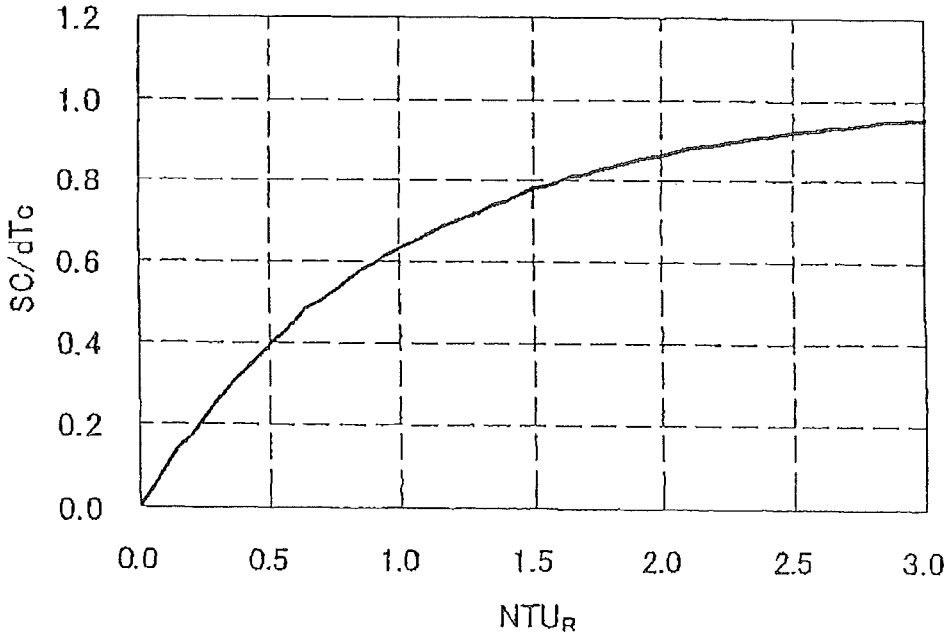
FIG. 3 is a relational graph of $SC/dT_c$ and $NTU_R$ of the air conditioner.
Figure 4:
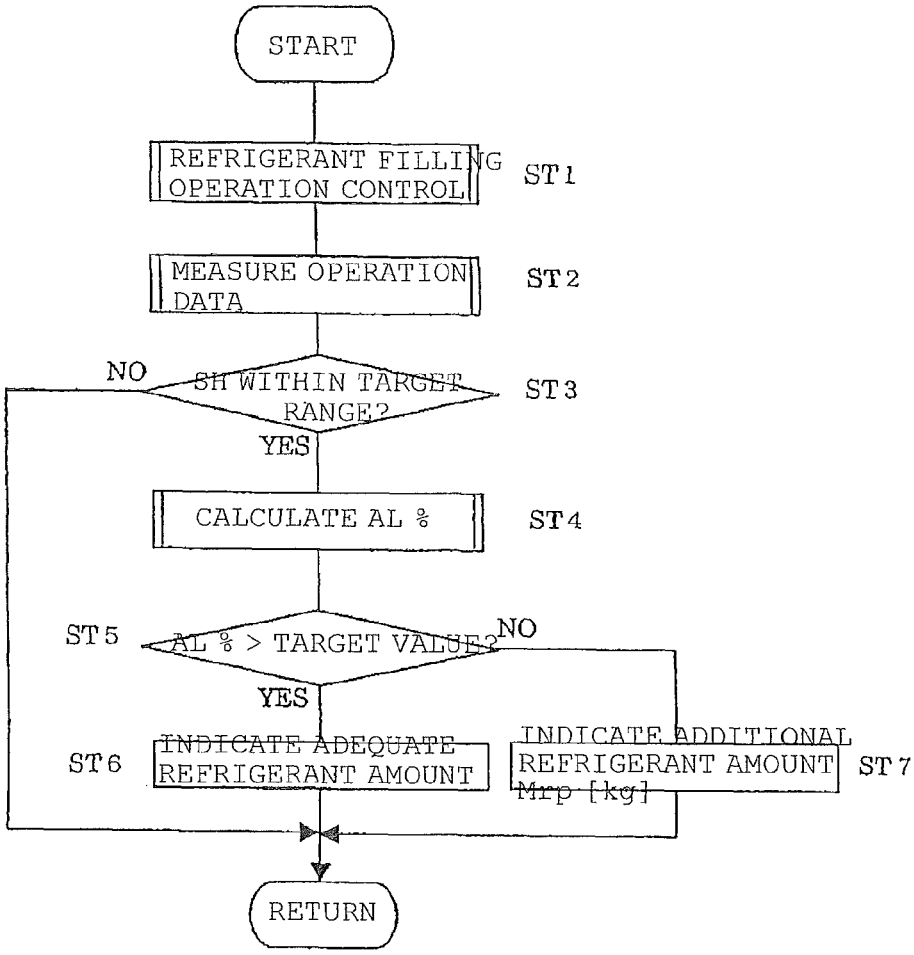
FIG. 4 is a flowchart of a refrigerant filling amount judging operation of the air conditioner.
Figure 5:
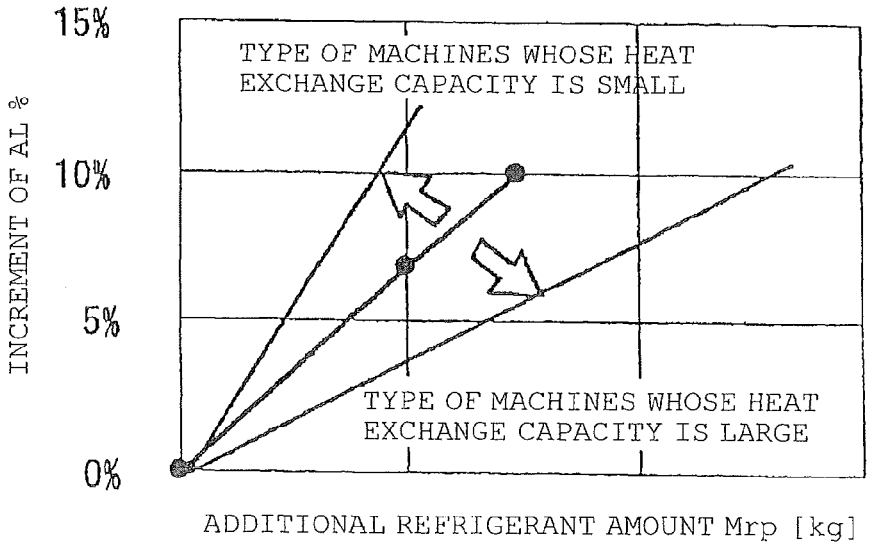
FIG. 5 is a relational chart of a phase area rate $A_L$ % and an additional refrigerant amount of the air conditioner.
Figure 6:
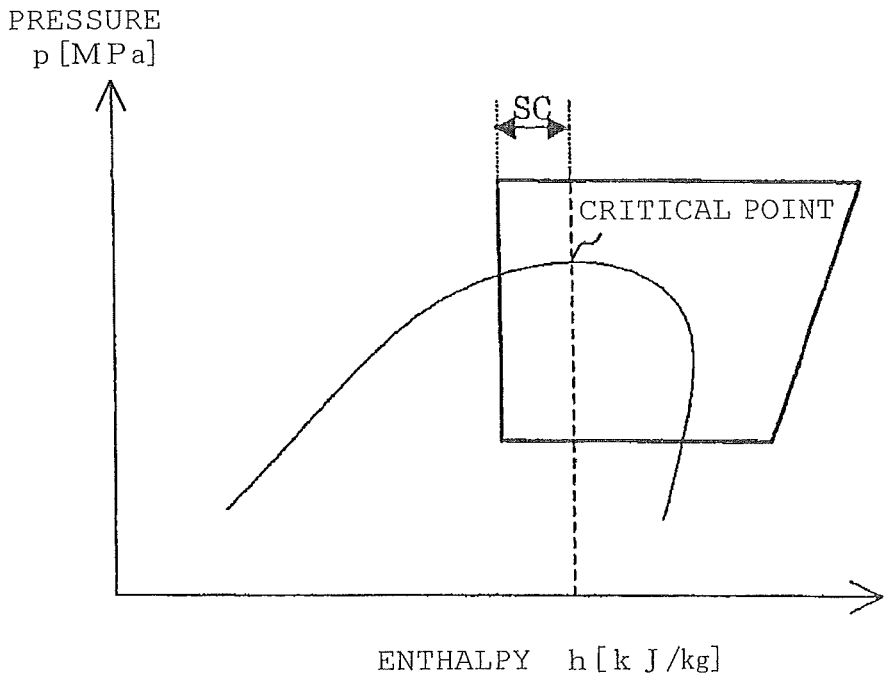
FIG. 6 is a graph showing a method for calculating SC at a super-critical point of the air conditioner.

FIGS. 1 through 6 are drawings for explaining a first embodiment, wherein FIG. 1 is a diagram showing a structure of an air conditioner of the first embodiment, FIG. 2 is a p-h diagram of the air conditioner when refrigerant is insufficient, FIG. 3 is a relational graph of $SC/dT_c$ and $NTU_R$ of the air conditioner, FIG. 4 is a flowchart of a refrigerant filling amount judging operation of the air conditioner, FIG. 5 is a relational chart of a phase area rate $A_L$ % and an additional refrigerant amount of the air conditioner and FIG. 6 is a graph showing a method for calculating SC at a super-critical point of the air conditioner.

The air conditioner of the present embodiment is composed of a refrigerating cycle 20 having a heat pump function capable of supplying heat obtained by heat exchange with the outdoor air to the inside of a room. The refrigerating cycle 20 includes an outdoor machine having a compressor 1, a four-way valve 2 as a switch valve for switching as indicated in the figure by solid lines during a cooling operation and as indicated by broken lines during a heating operation, an outdoor heat exchanger 3 that functions as a high pressure-side heat exchanger (condenser) during the cooling operation and as a low pressure-side heat exchanger (evaporator) during the heating operation, an outdoor blower 4 as a fluid sending section for supplying fluid such as air to the outdoor heat exchanger 3 and a throttle device 5*a* for expanding high-temperature and high-pressure liquid condensed by the condenser into low temperature and low pressure refrigerant, indoor machines having a plurality of indoor heat exchangers 7*a* and 7*b* functioning as the low pressure-side heat exchangers (evaporators) during the cooling operation and as the high pressure-side heat exchangers (condensers) during the heating operation, indoor blowers 8*a* and 8*b* as fluid sending sections for supplying fluid such as air to the indoor heat exchangers 7*a* and 7*b* and throttle devices 5*b* and 5*c*, and connection pipes 6 and 9 for connecting the indoor machines and the outdoor machine.

Although the object of heat absorption of the condensed heat of the refrigerant in the condenser of the air conditioner described above is air, it may be water, refrigerant, brine or the like and a supplier of the object of heat absorption may be a pump or the like. Furthermore, although FIG. 1 shows a case of two indoor machines, three or more indoor machines may be adaptable. A capacity of the respective indoor machines may also differ or may be same. Still more, the outdoor machine may be composed of a plurality of machines in the same manner.

The refrigerating cycle 20 is provided with a compressor outlet temperature sensor 201 (refrigerant temperature detecting section on the inlet side of the high pressure-side heat exchanger) for detecting temperature of the compressor 1 on the side of the discharge side. It is also provided with an outdoor machine two-phase temperature sensor 202 (the high-pressure refrigerant temperature detecting section during the cooling operation and the low pressure refrigerant temperature detecting section during the heating operation) for detecting condensation temperature of the outdoor heat exchanger 3 during the cooling operation, and an outdoor heat exchanger outlet temperature sensor 204 (the refrigerant temperature detecting section on the outlet side of high pressure-side heat exchanger during the cooling operation) for detecting the refrigerant outlet temperature of the outdoor heat exchanger 3. These temperature sensors are provided so as to keep in contact with or to be inserted into the refrigerant pipe to detect the refrigerant temperature. An outdoor temperature sensor 203 (fluid temperature detecting section) detects an outdoor ambient temperature.

There are also provided indoor heat exchanger inlet temperature sensors 205*a* and 206*a* (the refrigerant temperature detecting sections on the outlet side of the high pressure-side heat exchanger during the heating operation) on the refrigerant inlet side during the cooling operation of the indoor heat exchangers 7*a* and 7*b*, temperature sensors 208*a* and 208*b* on the outlet side of the indoor heat exchangers and indoor machine two-phase temperature sensors 207*a* and 207*b* (the low pressure refrigerant temperature detecting section during the cooling operation and the high-pressure refrigerant temperature detecting section during the heating operation) for detecting evaporating temperature during the cooling operation. An intake temperature sensor 209 (compressor intake side temperature detecting section) is provided in front of the compressor 1 and is disposed in the same manner with the outdoor machine two-phase temperature sensor 202 and the outdoor heat exchanger outlet temperature sensor 204. Indoor intake temperature sensors 206*a* and 206*b* (fluid temperature detecting section) detect indoor ambient temperature.

Each value detected by each temperature sensor is inputted to a measuring section 101 and is processed by a computing section 102. A control section 103 controls the compressor 1, the four-way valve 2, the outdoor blower 4, the throttle devices 5*a* and 5*c* and the indoor blowers 8*a* and 8*b* based on the result of the computing section 102, to control the refrigerating cycle to fall within a desired control target range. A storage section 104 stores the result obtained by the computing section 102 and a comparing section 105 compares the stored values with values of the present refrigerating cycle state. A judging section 106 judges a refrigerant filling amount of the air conditioner from the comparison result of the comparing section 105 and an announcing section 107 announces the judged result to a LED (light Emitting Diode), a distant monitor and the like. Here, the computing section 102, the storage section 104, the comparing section 105 and the judging section 106 are called as a computation judging section 108 altogether.

It is noted that the measuring section 101, the control section 103 and the computation judging section 108 may be composed of a microcomputer or a personal computer.

Furthermore, the control section 103 is connected with the respective devices within the refrigerating cycle as shown by chain lines through wires or by wireless to control the respective devices appropriately.

Next, a refrigerant filling amount judging algorithm of the computation judging section 108 implemented in judging an adequate refrigerant filling amount of the air conditioner described above will be explained.

FIG. 2 is a p-h diagram showing changes of the refrigerating cycle in the case where an air condition, compressor frequency, an opening angle of throttle device and control amounts of the outdoor and indoor blowers are fixed in the same system configuration as the air conditioner described above, and only a charged refrigerant amount is changed. Density of the refrigerant is high in a high-pressure liquid phase condition, so that the charged refrigerant exists most in the condenser part. When the refrigerant amount decreases, a volume of the condenser occupied by the liquid refrigerant decreases, so that it is apparent that the liquid phase supercooling degree SC of the condenser is largely correlated with the refrigerant amount.

Solving the liquid phase region of the condenser from the relational expression (Non-Patent Document 1: "Compact Heat Exchanger" by Hiroshi Seshita and Masao Fujii, The Daily Industrial News, 1992) of thermal balance of the heat exchanger leads to a non-dimensionalized expression (1):

$$SC/dT_c=1-\mathrm{EXP}(-NTU_R) \tag{1}$$

FIG. 3 shows the relationship of the expression (1).

Where, SC is a value obtained by subtracting a condenser outlet temperature (a detected value of the outdoor heat exchanger outlet temperature sensor 204) from condensation temperature (a detected value of the outdoor machine two-phase temperature sensor 202). dTc is a value obtained by subtracting the outdoor temperature (a detected value of the outdoor temperature sensor 203) from the condensation temperature.

The left side of the expression (1) represents temperature efficiency of the liquid phase portion, so that this will be defined as liquid phase temperature efficiency $\epsilon_L$ shown in the following expression (2):

$$\epsilon_L-SC/dT_c \tag{2}$$

$NTU_R$) on the right side of the expression (1) is a number of transfer unit on the refrigerant side and is expressed by the following expression (3):

$$NTU_R=(K_e\times A_L)/(G_r\times C_{pr}) \tag{3}$$

Where, $K_c$ is an overall heat transfer coefficient [J/s·m$^2$·K] of the heat exchanger, $A_L$ is a heat transfer area [m$^2$] of the liquid phase, $G_r$ is mass flow rate [kg/s] of the refrigerant and $C_{pr}$ is specific heat at constant pressure [J/kg·K].

The expression (3) contains the overall heat transfer coefficient $K_c$ and the heat transfer area $A_L$ of the liquid phase. However, the overall heat transfer coefficient $K_c$ is an uncertain element because it varies by being influenced by outside wind and by shape of fins of the heat exchanger, and the heat transfer area $A_L$ is also a value that varies depending on specifications of the heat exchanger and on conditions of the refrigerating cycle.

Next, an approximate thermal balance expression on the air side and the refrigerant side of the overall condenser may be expressed as follows:

$$K_c \times A \times dT_c = G_r \times \Delta H_{COM} \tag{4}$$

Where, A represents a heat transfer area [m2] of the condenser and $\Delta H_{CON}$ is a difference of enthalpy at the inlet and outlet of the condenser. The enthalpy of the inlet of the condenser may be found from the compressor outlet temperature and the condensation temperature.

It becomes possible to express $NTU_R$ without containing factors such as the outside wind and the shape of the fin by eliminating $K_G$ from the expressions (3) and (4) and by rearranging them to the following expression (5):

$$NTU_R = (\Delta H_{COM} \times A_L)/(dT_c \times C_{pr} \times A) \tag{5}$$

Here, one obtained by dividing the heat transfer area $A_L$ of the liquid phase by the heat transfer area A of the condenser will be defined as the following expression (6):

$$A_L/A = A_L\,\% \tag{6}$$

$A_L$ % may be expressed by the following expression (7) by solving it by the expressions (1), (5) and (6):

$$A_L\,\% = -\mathrm{Ln}\left(1 - \frac{SC_{(k)}}{dTc_{(k)}}\right) \times \frac{dTc_{(k)} \times Cpr_{(k)}}{\Delta Hcon_{(k)}} \tag{7}$$

$A_L$ % is a parameter representing a liquid phase area rate that is the liquid phase portion of the condenser and becomes an index for judging the refrigerant filling amount when the refrigerant is reserved in the condenser.

The expression (7) shows a case when there is one condenser. However, when there is a plurality of condensers $A_L$ % may be expressed by the following expression (8) by calculating SC, $dT_c$, $C_{pr}$, and $\Delta H_{COM}$ of the respective condensers and by calculating a weighted mean value of each indoor machine:

$$A_L\,\% = \frac{\sum_{k=1}^{n}\left(Q_{j(k)} \times \left[-\mathrm{Ln}\left(1 - \frac{SC_{(k)}}{dTc_{(k)}}\right) \times \frac{dTc_{(k)} \times Cpr_{(k)}}{\Delta Hcon_{(k)}}\right]\right)}{\sum_{k=1}^{n} Q_{j(k)}} \tag{8}$$

Where, $Q_j(k)$ represents a heat exchange capacity of each condenser (e.g., air conditioning capacity of 28 kW), k is a number of the condenser and n is a total number of the condensers. The outdoor machine becomes the condenser in case of cooling and the indoor machine becomes the condenser in case of heating. In the exemplary structure shown in FIG. 1, there is a plurality of indoor machines and the expression (8) is applied during heating. It is noted that a plurality of condensers exist in the cooling operation in case of the circuit structure in which a plurality of outdoor machines is connected, $A_L$ % is calculated by the expression (8) also in this case.

Next, a case when this refrigerant filling amount judging algorithm is applied to the air conditioner will be explained based on a flowchart in FIG. 4. FIG. 4 is a flowchart showing steps of judging the refrigerant filling amount by the computation judging section 108.

At first, a refrigerant filling operation control of the air conditioner is carried out in Step 1. The refrigerant filling operation control is carried out after installing the machine or in filling the refrigerant again after discharging it once for maintenance. The control may be made by a control signal from the outside through a wire or by wireless. The refrigerant filling operation control is carried out so that frequency of the compressor 1 and a number of revolutions of the outdoor blower 4 and the indoor blowers 8*a* and 8*b* become constant. During the cooling operation, the control section 103 controls the opening angles of the throttle devices 5*b* and 5*c* so that low pressure of the refrigerating cycle falls within a predetermined control target value range set in advance so that a evaporator outlet super-heating degree (a difference between 208*a* and 207*a* on the side of the indoor machine 7*a*) is brought about. During the heating operation, the control section 103 controls the opening angle of the throttle device 5*a* so that low pressure of the refrigerating cycle falls within a predetermined control target value range set in advance so that a compressor intake side super-heating degree is brought about.

Furthermore, when it is difficult to carry out a compressor frequency fixed operation corresponding to environmental conditions such as atmospheric temperature, it is possible to arrange so that the during the cooling operation, the control section 103 controls the high pressure of the refrigerating cycle so that it falls within a predetermined control target value range set in advance by the number of revolutions of the outdoor blower 4 and the control section 103 controls the low pressure of the refrigerating cycle so that it falls within a predetermined control target value range set in advance by the number of revolutions of the compressor 1 so that the super-heating degree is brought about on the intake side of the compressor or at the outlet of the evaporator and to arrange so that the during heating operation, the control section 103 also controls the high pressure of the refrigerating cycle so that it falls within a predetermined control target value range set in advance by the number of revolutions of the compressor 1 and the control section 103 controls the low pressure of the refrigerating cycle so that it falls within a predetermined control target value range set in advance by the number of revolutions of the outdoor blower 4 so that the super-heating degree is brought about on the intake side of the compressor or at the outlet of the evaporator.

Next, operation data such as pressure and temperature at predetermined position of the refrigerating cycle is taken into and is measured by the measuring section 101 in Step 2. Then, the computing section 102 calculates values such as super-heating degree (SH) and super-cooling degree (SC). Then, it is judged in Step 3 whether or not the control target evaporator outlet side super-heating degree (SH) or compressor intake side super-heating degree (SH) is within the target range. The target super-heating degree SH is 10±5° C. for example.

A purpose of controlling the super-heating degree within the target range is to keep the refrigerant amount on the evaporator side constant during the control of refrigerant filling operation by keeping the outlet operation state on the evaporator side constant so that much liquid refrigerant with a large density does not remain on the evaporator side. The refrigerant other than that remains mainly in the connection pipe 6 as an extension pipe on the liquid side and the condenser, so that it becomes possible to detect the refrigerant filling amount by the liquid phase area ratio of the condenser.

When the super-heating degree (SH) is within the target range in Step 3, $A_L$ % is calculated next in Step 4. The expression (8) may not be calculated when the refrigerant is extremely insufficient and the super-cooling degree (SC) is not created. However, $A_L$ % is set to be 0 in such a case. Then, $A_L$ % is compared with a predetermined value (or a target value) set in advance as a refrigerant amount adequate amount to judge whether or not it is equal to or more than the predetermined value in Step 5. When it is judged to be equal to or more than the predetermined value, the announcing section 107 indicates that it is an adequate refrigerant amount in Step 6. While the refrigerant amount adequate value is 10% for example, it may be changed corresponding to a type of machines and capacity. It may be also changed in cooling and heating.

Beside indicating through the LED, the announcing section 107 may be arranged so as to output a signal to remote communication means such as portable telephones, wired telephone lines and LAN lines in addition to devices attached to the body of the air conditioner such as a display screen such as a liquid crystal display, an alarm, a contact signal, a voltage signal and switching of electromagnetic valve or to the outside terminal.

When $A_L$ % is less than the target value in the judgment in Step 5, the announcing section 107 indicates an additional refrigerant amount Mrp [kg] in Step 7. Here, the additional refrigerant amount Mrp may be obtained from a difference between the target value of $A_L$ % and the present $A_L$ % by storing rates of change of $A_L$ % and Mrp in the storage section 104 in advance as shown in FIG. 5 for example. It is noted that the relationship between $A_L$ % and Mrp varies depending on a capacity of the heat exchanger. When the axis of abscissas is Mrp and the axis of ordinate is $A_L$ %, the larger the capacity, the smaller an inclination becomes. Therefore, it becomes possible to predict an adequate additional refrigerant amount by storing a capacity of the object type machine in the storage section 104 in advance. Still more, because the capacity of the heat exchanger is substantially proportional to an air conditioning capacity of its indoor machine or outdoor machine, a method of estimating the capacity of the heat exchanger from the air conditioning capacity may be adopted.

Then, after adding the additional refrigerant amount specified in Step 7 to the refrigerating cycle, the process is carried out again in accordance to the flowchart in FIG. 4 to judge an adequate refrigerant amount. This process of the additional filling and the judgment is repeated until the time when the judged result becomes the adequate refrigerant amount.

Further, a refrigerant filling flow rate varies depending on internal pressure of the cylinder. Because the internal pressure of the cylinder may be found from conversion of refrigerant saturation pressure of the outside air temperature, it is possible to predict a necessary remaining time for filling the refrigerant by predicting the refrigerant filling flow rate [kg/min] and by dividing the additional refrigerant amount Mrp [kg] by the refrigerant filling flow rate. The announcing section 107 indicates this remaining filling time in Step 7, so that an operator can predict a remaining operation time and can enhance a work efficiency. When the filling is completed, the announcing section 107 also indicates that the filling has been completed, so that the operator can know whether or not the operation has been completed even when the operator returns to the site after being away for a while.

It is also possible to find the insufficient refrigerant amount, i.e., the additional refrigerant amount Mrp, even when a leak of the refrigerant occurs after initially installing the air conditioner by carrying out the refrigerant filling operation control explained in FIG. 4 again. Then, the announcing section 107 indicates the additional refrigerant amount Mrp to the body of the air conditioner or outputs its signal to the remote communication means, so that the required refrigerant filling amount is found and a serviceman can grasp the required refrigerant amount in advance before going to the site for maintenance. Accordingly, it becomes possible to save works by eliminating unnecessary works such as bringing an excessive amount of refrigerant cylinders.

It is noted that the saturation temperature used in this refrigerant amount detecting algorithm, may be gotten from the outdoor machine two-phase temperature sensor 202 and the indoor machine two-phase temperature sensors 207*a* and 207*b*, or may be calculated from pressure information of a high pressure detecting pressure sensor for detecting pressure of the refrigerant at any position in a passage from the compressor 1 to the throttle device 5*a* or of a low pressure detecting pressure sensor for detecting pressure of the refrigerant at any position in a passage from the low pressure-side heat exchanger to the compressor 1.

The air conditioner of the invention can accurately judge the refrigerant filling amount and to fill the adequate refrigerant amount corresponding to an object machine even in any installation and environmental conditions by the arrangement described above.

It is noted that the air conditioner of the invention may be arranged so as to eliminate the comparing section 105 and 106 from the structure shown in FIG. 1 and to indicate the condenser liquid phase area ratio calculated by the computing section 102 directly on the announcing section 107. It is because the operator can judge the adequate refrigerant amount on the basis of the indicated condenser liquid phase area ratio and can deal with it by adding refrigerant if necessary in this case.

While the case described above is a case when the refrigerant becomes the two-phase state in the condensation process, there exists no saturation temperature when the refrigerant within the refrigerating cycle is a high-pressure refrigerant such as $CO_2$ which changes its state by pressure of super critical point or more. However, it is possible to judge the refrigerant filling amount even for the refrigerant whose condensing pressure exceeds the critical pressure. That is because the SC becomes small during a leak of refrigerant with the same idea as the refrigerant becomes two-phase states during the condensing process by assuming a cross point of enthalpy at the critical point and a measured value of the pressure sensor as the saturation temperature as shown in FIG. 6 and by calculating it as the super-cooling degree (SC) from the outdoor heat exchanger outlet temperature sensor 204.

Next, a method for judging whether or not the present refrigerant amount is adequate by comparing a value of $A_L$ % of the target refrigerant amount in the operation state obtained theoretically from the law of conservation of mass with a value obtained based on the actually measured values will be explained.

$A_L$ % may be expressed also by the following expression (9) in connection with the refrigerant capacity rate of the condenser:

$$A_L\ \% = V_{L_CON} / V_{CON} = M_{L_CON} / (V_{CON} \cdot \rho_{L_CON}) \quad (9)$$

Where, the symbol V denotes volume [$m^3$], M denotes a mass [kg] of the refrigerant and ρ denotes density [$kg/m^3$]. The subscript L denotes the liquid phase and CON denotes the condenser.

The expression (9) may be expressed by the following expression (10) by applying the law of conservation of mass of the refrigerating cycle to the expression (9) to reduce $M_{L_CON}$.

$$A_L\%=(M_{CYC}-M_{S_CON}-M_{G_CON}-M_{S_PIPE}-M_{G_PIPE}-M_{EVA})/(V_{CON}\cdot\rho_{L_CON}) \quad (10)$$

Where, the subscript CYC denotes the whole refrigerating cycle, G denotes the gaseous phase, S denotes the two phase, PIPE denotes the connecting pipe and EVA denotes the evaporator. The following expression (11) may be obtained by transforming the expression (10):

$$A_L\%=((M_{CYC}-M_{G_CON}-M_{G_PIPE}-M_{EVA})-V_{S_CON}\cdot\rho_{S_CON}-V_{S.PIPE}\cdot\rho_{S.EVAin}-V_{S_EVA}\cdot\rho_{S_EVA})/(V_{CON}\cdot\rho_{L_CON}) \quad (11)$$

Where, the subscript EVAin denotes the inlet of the evaporator.

Although various correlation expressions have been proposed to find the average density of the two-phase regions $\rho_{S_CON}$ and $\rho_{S.EVA}$ expressed in the expression (11), it may be approximated by the following expression (12) because it is substantially proportional to the mass flow rate $G_r$ when the saturation temperature is constant and is substantially proportional to the saturation temperature when the mass flow rate $G_r$ is constant, according to the correlation expression of CISE (second Non-Patent Document: "Proc. 5th Int. Heat Transfer Conference" by G. P. Gaspari, 1974):

$$\rho s=A\cdot T_s+B\cdot G_r+C \quad (12)$$

Where, the symbols A, B and C are constants and $T_s$ denotes the saturation temperature.

The density $\rho_{S.EVAin}$ of the local portion of the two-phase region expressed by the expression (11) may be similarly approximated by the following expression (13):

$$\rho_{S_EVAm}=A'\cdot T_e+B'\cdot G_r+C'\cdot X_{EVAin}+D' \quad (13)$$

Where, the symbols A', B', C' and D' are constants, $T_e$ denotes the evaporation temperature and $X_{EVAin}$ denotes dryness of the inlet of the evaporator.

$A_L$ % may be expressed by following expression (14) by substituting the expressions (12) and (13) into the expression (11) and rearranging it:

$$A_L\%=(a0\cdot T_c+b0\cdot G_r+c0\cdot X_{EVAin}+d0\cdot T_e+e0)/\rho_{L_CON} \quad (14)$$

Where, a0, b0, c0, d0 and e0 are constants.

It is necessary to know the operation conditions at the time when the operation pattern is changed in five conditions in order to decide the five constants of these unknown numbers a0, b0, c0, d0 and e0. However, $G_r$ may be treated substantially as a constant if the compressor frequency is fixed, and $T_c$ may be supposed to proportional to $T_e$ if the super-heating degree control has been made. Therefore, the theoretical value $A_L$ %* of $A_L$ % theoretically calculated by applying the expression (9) of conservation of mass may be reduced finally as the following expression (15) by reducing the expression (14). It is rioted that the theoretical value of $A_L$ % will be denoted as $A_L$ %* hereinafter in order to distinguish from the measured value of $A_L$ %:

$$A_L\%^*=(a\cdot T_C^2+b\cdot X_{EVAin}+c\cdot T_e+d)/\rho_{L_CON} \quad (15)$$

Because the expression (15) has four unknown numbers a, b, c and d, it is possible to decide values of the four constants in advance by a test or to obtain them by a cycle simulation and to record them in the storage section 104.

The expression (15) is an expression related only to the liquid phase of the condenser and is an effective expression regardless of the length of the extension pipe because the influence of the refrigerant amount of the extension pipe is eliminated. It is then possible to decide the unknown numbers a, b, c and d in the expression (15) by a test or simulation under conditions such as a case when a connected capacity ratio of typical indoor and outdoor machines, e.g., the capacity of the indoor machine to the capacity of the outdoor machine, is 100%. Further, the unknown number d is a constant not related to the operation state but related to the connection capacity. Therefore, it is possible to obtain $A_L$ %* corresponding to the connection state of the object system by changing (from the correlation such as proportionality to the capacity of the indoor machine) the value of d when the connection capacity ratio changes.

Here, the theoretical value $A_L$ %* decides each constant a, b, c and d in the target refrigerating cycle refrigerant amount so that it is the target value of $A_L$ %. Therefore, a relationship of $A_L$ %=$A_L$ %* holds when the air conditioner is operated with the refrigerant amount of the target filling amount. When the refrigerant amount is insufficient, $A_L$ % is smaller than $A_L$ %*, and when the refrigerant amount is excessive, $A_L$ % is larger than $A_L$ %*. Therefore, it is possible to judge whether or not the refrigerant amount is adequate by comparing $A_L$ % with $A_L$ %*.

The refrigerant amount judging algorithm using the theoretical value $A_L$ %* may be also carried out along the flowchart in FIG. 4. In this case, the theoretical value $A_L$ %* becomes the target value (corresponds to the predetermined value explained before). The four constants a, b, c and d are stored in the storage section 104 in advance and $A_L$ %* is also calculated in addition to $A_L$ % in Step 4 in FIG. 4. Then, $A_L$ % is compared with $A_L$ %* in Step 5. When $A_L$ % is larger than the target value of $A_L$ %*, the refrigerant amount is adequate. When it is smaller, the additional refrigerant amount Mrp is found from a deviation of $A_L$ % and $A_L$ %*. Mpr is proportional to $A_L$ % as explained in FIG. 5 and the inclination of the variation of Mrp to $A_L$ % changes depending on the condenser heat exchanger capacity. Accordingly, it is possible to find the additional refrigerant filling amount from the deviation of $A_L$ % and $A_L$ %* and the relationship in FIG. 5.

Second Embodiment

Next, a second embodiment of the invention will be explained with reference to a drawing. The same parts with those of the first embodiment will be denoted by the same reference numerals and a detailed explanation thereof will be omitted here.

Figure 7:
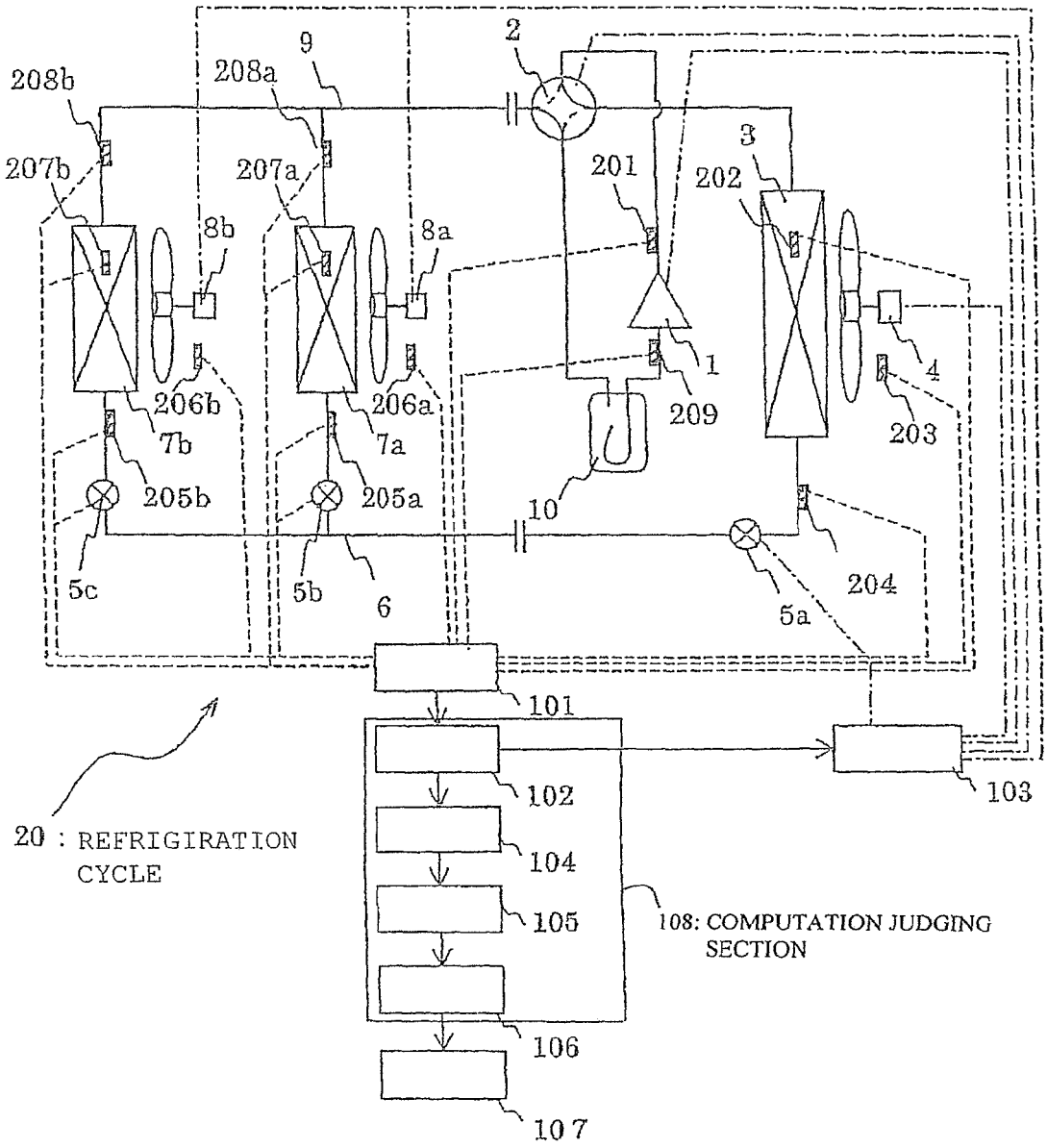
FIG. 7 is a diagram showing a structure of the air conditioner of a second embodiment.

FIG. 7 is a diagram showing a structure of the air conditioner of the second embodiment. The air conditioner is arranged so as to add an accumulator 10 at the intake part of the compressor in the structure in FIG. 1 to reserve an extra refrigerant amount that is a difference of required refrigerant amounts in cooling and heating therein. This is a type of air conditioner that requires no refrigerant to be added at the site.

When there exists the accumulator 10, the operation must be carried out so as not to reserve the liquid refrigerant in the accumulator 10. Therefore, during the cooling operation, the operation is carried out so as to throttle the throttle devices 5*b* and 5*c* so that enough evaporator outlet super-heating degree is brought about in the indoor heat exchangers 7*a* and 7*b* to lower the evaporation temperature detected by the indoor heat exchanger inlet temperature sensor 205 or the indoor machine two-phase temperature sensor 207 (special operation mode). During the heating operation, the operation is carried out so as to throttle the throttle device 5*a* so that compressor intake super-heating degree is brought about (special operation mode).

Preferably, the air conditioner has a timer (not shown) therein and has a function of entering the special operation mode per certain time by the timer.

Furthermore, preferably, the air conditioner has a function of entering the special operation mode even by a control signal from the outside through wire or by wireless.

By constructing as described above, the air conditioner having the accumulator 10 can also detect the adequate refrigerant amount accurately even under any installation and environmental conditions in the same manner as that described in the first embodiment without using the prior art detector for detecting the liquid face.

Third Embodiment

Next, a third embodiment of the invention will be explained with reference to a drawing. The same parts with those of the first embodiment will be denoted by the same reference numerals and a detailed explanation thereof will be omitted here.

Figure 8:
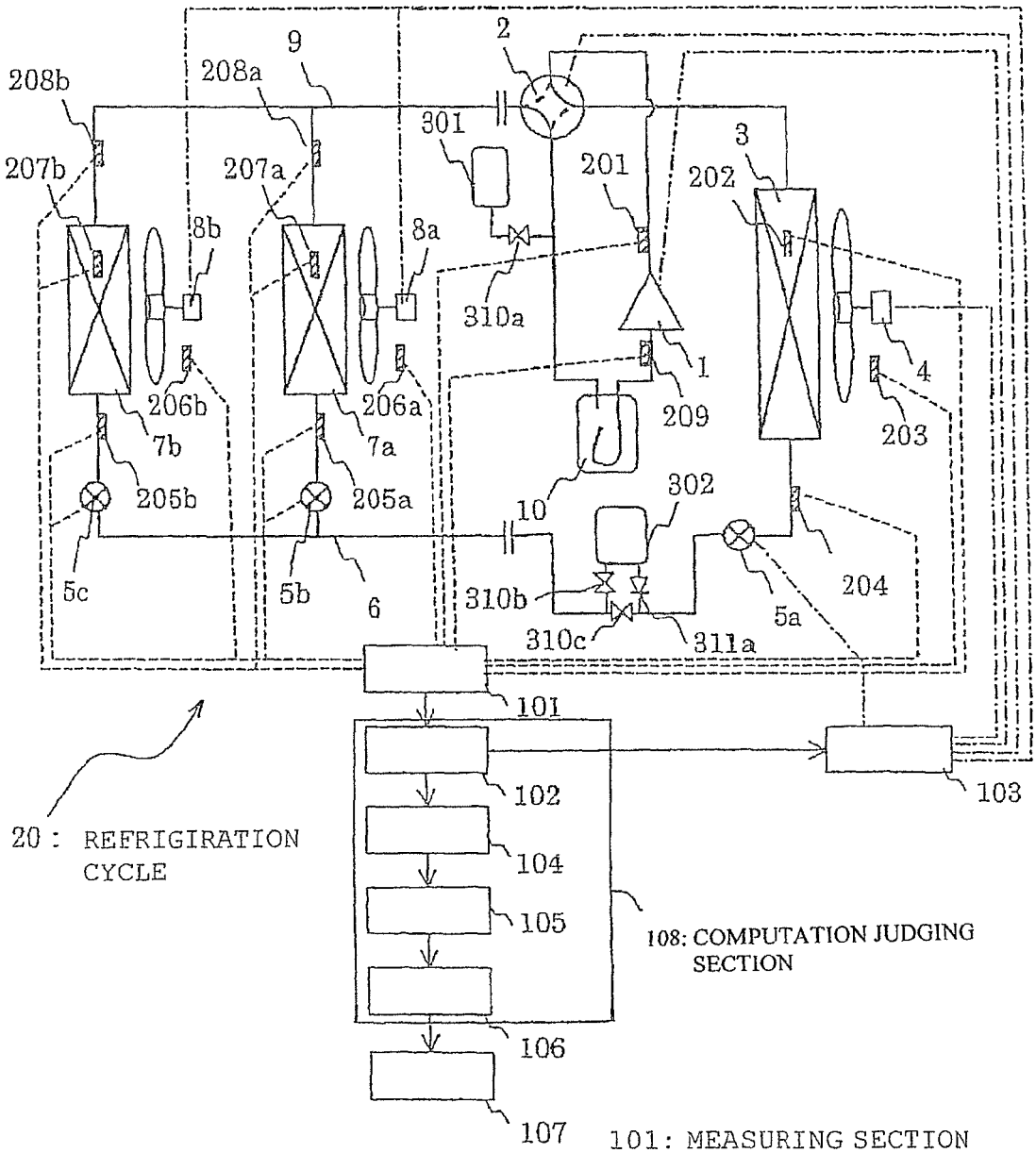
FIG. 8 is a diagram showing a structure of the air conditioner of a third embodiment.

FIG. 8 is a diagram in which a low-pressure receiver 301, an electromagnetic valve 310*a* accompanying thereto, a high-pressure receiver 302 and electromagnetic valves 310*b* and 310*c* as well as a check valve 311*a* accompanying thereto are added to the structure shown in FIG. 7. When the air conditioning capacities (or volumes) of the outdoor heat exchanger 3 and the indoor heat exchangers 7*a* and 7*b* are unbalanced and the air conditioning capacity of the indoor heat exchanger is considerably smaller than that of the outdoor heat exchanger e.g., the indoor air conditioning capacity is 50% of the outdoor air conditioning capacity, there is a possibility that the refrigerant amount required in cooling (when the outdoor heat exchanger whose volume is large is the condenser) cannot be fully reserved in the indoor machine whose air conditioning capacity is small (it is necessary to absorb a difference of refrigerant amounts in cooling and heating during filling by means other than the accumulator so as to reserve no liquid refrigerant in the accumulator 10 while filling the refrigerant). In this case, it is possible to absorb the difference of refrigerant amounts in cooling and heating by providing the low-pressure receiver 301 or the high-pressure receiver 302 within the circuit. It is noted that the circuit may be arranged so as to attach only either one of the low-pressure receiver or the high-pressure receiver.

A method for absorbing the difference of refrigerant amounts in cooling and heating will be described below.

In case of the low-pressure receiver 301, the product is shipped in a state in which refrigerant of a predicted difference of refrigerant amounts in cooling and heating is reserved within the low-pressure receiver 301. Then, after installing the machine at the site, if the indoor heat exchanger is less than the outdoor heat exchanger in air conditioning capacity by a predetermined air conditioning capacity value based on information on connecting air conditioning capacity of the indoor machine grasped by the control section 103 through communications between the indoor and outdoor machines, and the heating refrigerant filling operation is completed, the refrigerant reserved in advance is released into the cycle. Thereby, because the deficient refrigerant amount during the heating filling is replenished to the cycle, the difference of refrigerant amounts in cooling and heating is eliminated. It is noted that there is no trouble that the refrigerant becomes excessive during the normal operation because the extra refrigerant generated during normal heating operation is reserved in the accumulator 10.

Next, a method for absorbing the difference of refrigerant amounts in cooling and heating by utilizing the high-pressure receiver 302 will be explained below.

When the indoor heat exchanger is less than the outdoor heat exchanger in air conditioning capacity by a predetermined air conditioning capacity value based on the information on connected air conditioning capacity of the indoor machine grasped by the control section 103 through the communications between the indoor and outdoor machines in heating refrigerant filling operation, the liquid refrigerant is reserved full in the high-pressure receiver 302 by opening the electromagnetic valve 310*a*. Because the state of the refrigerant at the place where the high-pressure receiver 302 is installed is liquid during the heating refrigerant filling operation, the liquid refrigerant within the circuit flows into the high-pressure receiver 302 by opening the electromagnetic valve 310*b* and closing the electromagnetic valve 310*c*, and the high-pressure receiver 302 is filled with the liquid. Furthermore, when the indoor air conditioning capacity is larger than a predetermined value and the difference of refrigerant amounts in cooling and heating is small, no extra refrigerant needs to be reserved, so that it becomes possible to realize the operation of not reserving the liquid refrigerant in the high-pressure receiver 302 by closing the electromagnetic valve 310*b* and opening the electromagnetic valve 310*c*. It is noted that no such a trouble that the refrigerant within the refrigerating cycle collects in the high-pressure receiver 302 and becomes insufficient occurs because no liquid collects in the high-pressure receiver 302 by closing the electromagnetic valve 310*b* and opening the electromagnetic valve 310*c* during the normal cooling.

As described above, it becomes possible to absorb the difference of refrigerant amounts in cooling and heating during filling the refrigerant by providing the low-pressure receiver 301 or the high-pressure receiver 302.

Furthermore, the difference of refrigerant amounts in cooling and heating during filling may be absorbed by using a method of manually replenishing necessary refrigerant by conducting the normal heating operation after heating refrigerant filling operation without using the low-pressure receiver 301 or the high-pressure receiver 302. Because the normal heating operation of reserving the liquid refrigerant within the accumulator 10 is made possible during the normal heating operation, it becomes possible to add the insufficient refrigerant amount by the heating operation. In this case, it becomes possible to fill an optimum refrigerant amount for the both cooling and heating operations by finding the optimum refrigerant amount from a combination of total air conditioning capacity of the indoor and outdoor machines and by manually adding the optimum refrigerant amount necessary for the system. Furthermore, the operator can fill the refrigerant accurately by storing a corresponding table corresponding to the combination of the air conditioning capacity of the indoor and outdoor machines in the storage section 104 in advance and by indicating the optimum refrigerant amount corresponding to the combination of the air conditioning capacity of the indoor and outdoor machines from information on the connection of the indoor and outdoor machines obtained by the control section 103 on the announcing section 107 after ending the heating refrigerant filling operation so that the operator can additionally fill the refrigerant by the indicated amount.

Fourth Embodiment

Next, a fourth embodiment of the invention will be explained with reference to a drawing. The same parts as those of the first embodiment will be also denoted by the same reference numerals and a detailed explanation thereof will be omitted here.

Figure 9:
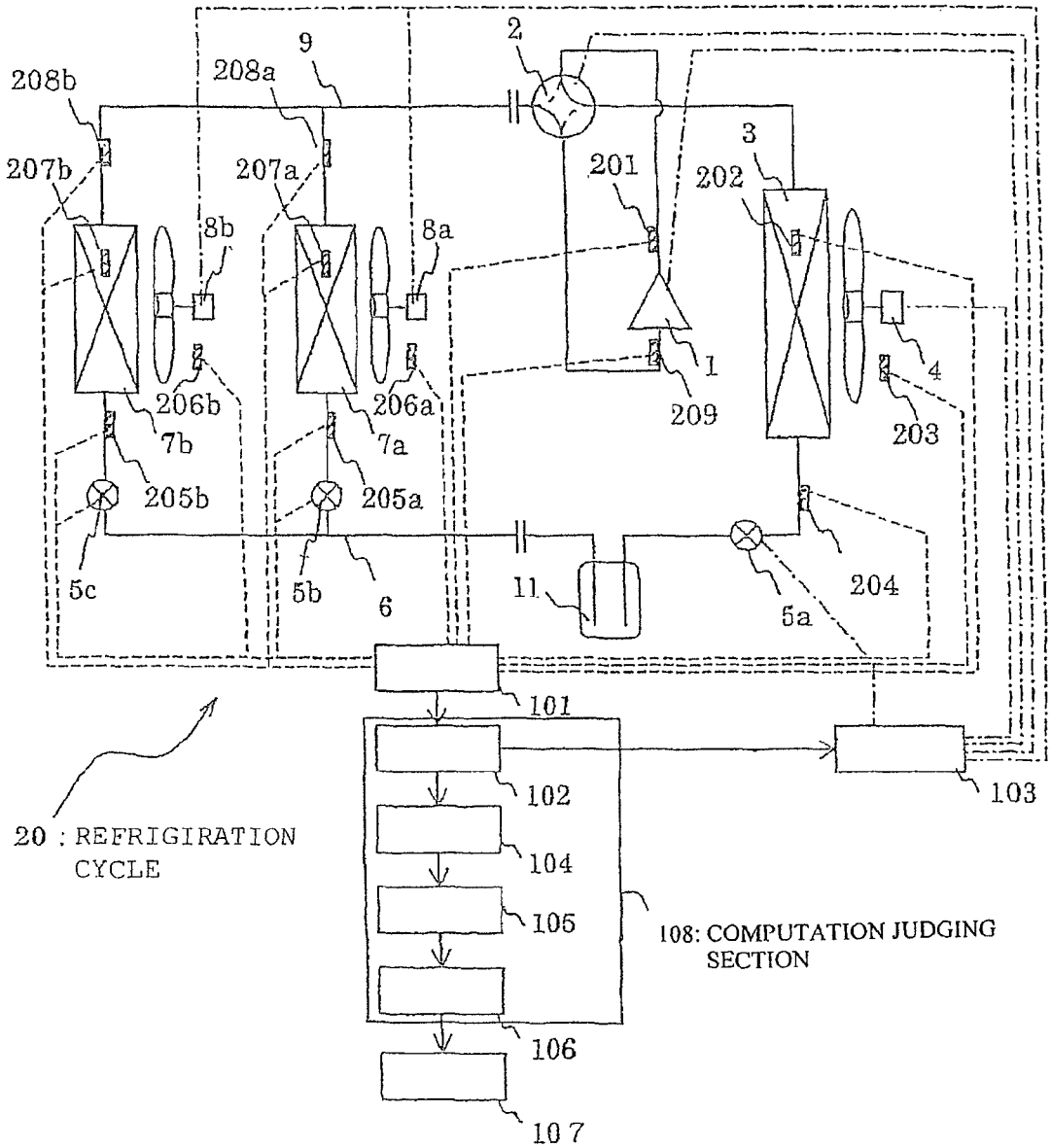
FIG. 9 is a diagram showing a structure of the air conditioner of a fourth embodiment.

FIG. 9 is a diagram showing a structure of the air conditioner of the fourth embodiment. This air conditioner is a type of air conditioner in which a receiver 11 for reserving the excessive refrigerant amount that is a difference of required refrigerant amounts in cooling and heating is added to the structure in FIG. 1 between the throttle device 5*a* (upstream side throttle device) and the throttle devices 5*b* and 5*c* (downstream side throttle devices) and which does not require to add refrigerant at the site.

Because there is the part for reserving the liquid refrigerant within the refrigerating cycle, an operation of controlling the opening angle of the throttle device 5*a* to be contracted and the opening angle of the outdoor blowers 5*b* and 5*c* to be opened more or less is carried out in the cooling operation, so as to carry out the operation (special operation mode) of reserving the extra refrigerant within the receiver 11 to the outdoor heat exchanger 3. Furthermore, an operation (special operation mode) of reserving the extra refrigerant within the receiver 11 into the indoor heat exchangers 7*a* and 7*b* is carried out by carrying out an operation of controlling the opening angle of the outdoor blowers 5*b* and 5*c* to be contracted and the opening angle of the throttle device 5*a* to be opened more or less.

By controlling as described above, it becomes possible to detect the optimum refrigerant amount accurately regardless of the installation and environmental conditions in the same manner as that described in the first embodiment without using the intrinsic detector for detecting the liquid face by the type of machine having the receiver 11.

It is noted that preferably, the air conditioner has a timer (not shown) therein and has a function of entering the special operation mode per each predetermined time by the timer.

Still more, preferably the air conditioner has a function of entering the special operation mode by a control signal supplied from the outside through a wire or by wireless.

When the air conditioning capacity of the indoor heat exchanger is considerably smaller than that of the outdoor heat exchanger in the present embodiment, it becomes possible to eliminate the deficiency of the refrigerant amount in heating filling in the same manner as that explained in the third embodiment by providing the low-pressure or high-pressure receiver as explained in the third embodiment. Still more, the method for manually replenishing the necessary refrigerant after ending heating filling as described in the third embodiment is also applicable.

Fifth Embodiment

Figure 10:
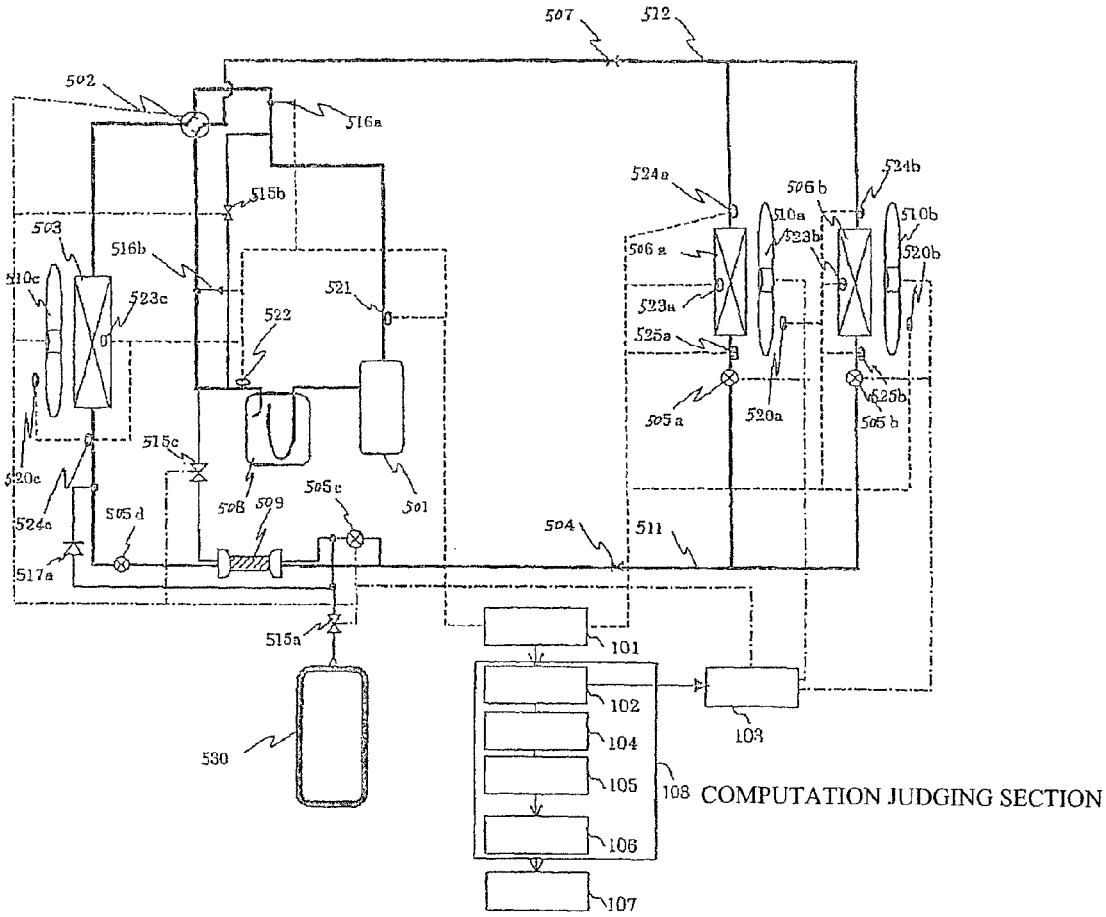
FIG. 10 is a diagram showing a structure of the air conditioner of a fifth embodiment.

FIG. 10 is a diagram showing a structure (structure of the refrigerating cycle) of the air conditioner of the first embodiment of the invention. In FIG. 10, a main refrigerant circuit of a heat source-side unit is constructed by connecting a compressor 501, a four-way valve 502, a heat source-side heat exchanger 503, an accumulator 508, a super-cooling heat exchanger 509 and a pressure regulating valve 505*d* (throttle device). Load-side units are composed of throttle devices composed of pressure regulating valves 505*a* and 505*b* and load-side heat exchangers 506*a* and 506*b*. The heat source-side unit is connected with the load-side unit through a liquid pipe 511, a gas pipe 512, a liquid-side ball valve 504 and a gas-side ball valve 507. The heat source-side heat exchanger 503 is provided with a fan (fluid sending section) 510*c* for blowing off air and the load-side heat exchangers 506*a* and 506*b* are also provided with fans (fluid sending sections) 510*a* and 510*b*. It is noted that the liquid-side ball valve 504 and the gas-side ball valve 507 are not limited to be a ball valve and may be any type of valve as long as it can carry out switching operations such as a switch valve and a control valve.

The four-way valve 502 is what switches the discharge and intake sides of the compressor 501 between the heat source-side unit and the load-side unit and may be another device that carries out the similar operations.

A primary passage of the super-cooling heat exchanger 509 is provided in a main refrigerant pipe connecting the heat source-side heat exchanger 503 and the liquid-side ball valve 504 and a secondary passage is provided in a sub refrigerant pipe connecting the intake side of the accumulator 508 with the super-cooling heat exchanger 509 and the liquid-side ball valve 504. Furthermore, an electromagnetic valve 515*c* is provided in the sub refrigerant pipe connecting the accumulator 508 with the secondary side of the super-cooling heat exchanger 509, and a pressure regulating valve 505*c* is provided in the sub refrigerant pipe connecting the secondary side of the super-cooling heat exchanger 509 with the main refrigerant pipe. It is noted that in FIG. 10, although a pressure regulating valve 505*d* is provided between the heat source-side heat exchanger 503 and the super-cooling heat exchanger 509, its position is not limited to that position and it may be between the heat source-side heat exchanger 503 and the liquid-side ball valve 504.

In the heat source-side unit, a refrigerant cylinder 530 as a refrigerant reservoir is branched via the electromagnetic valve 515*a* and one of the branched pipe is connected between the pressure regulating valve 505*c* and the secondary side of the super-cooling heat exchanger 509 and the other one is connected between the heat source-side heat exchanger 503 and the secondary side of the super-cooling heat exchanger 509. It is noted that the refrigerant cylinder 530 may be a refrigerant cylinder available at the installation site and may be connected at the site or may be built in the heat source-side unit. When the refrigerant cylinder is built in the heat source-side unit, the refrigerant is filled into a container that functions as a refrigerant cylinder in advance before shipping the product and is shipped while sealing the refrigerant in the container by closing the electromagnetic valve 515*a*. The electromagnetic valve 515*a* is not limited to be an electromagnetic valve and may be a valve that can be manually opened/closed by the operator while watching some outside output from the air conditioner such as a switch valve like a flow regulating valve.

Although the object of heat absorption of the condensed heat of the refrigerant in the condenser of the air conditioner described above is air, it may be water, refrigerant, brine or the like and a supplying device of the object of heat absorption may be a pump or the like. Furthermore, although FIG. 10 shows a case that the load-side unit is composed of two machines, the load-side unit may be composed of plural number of machines such as three or more. Capacity of the respective load-side units may also differ or may be same. Still more, the heat source-side unit may be composed of a plurality of connected machines in the same manner.

Next, sensors and a measurement control section will be explained. A discharge temperature sensor 521 (high pressure-side heat exchanger inlet-side refrigerant temperature detecting section) for detecting temperature is provided on the discharge side of the compressor 501. There are also provided a heat-exchange temperature sensor 523*c* (the high-pressure refrigerant temperature detecting section during the cooling operation and the low pressure refrigerant temperature detecting section during the heating operation) of the heat source-side heat exchanger for detecting condensation temperature of the heat source-side heat exchanger 503 during the cooling operation and a heat exchange outlet temperature sensor 524*c* (the refrigerant temperature detecting section on the outlet side of high pressure-side heat exchanger during the cooling operation) for detecting the refrigerant outlet temperature of the heat source-side heat exchanger 503. These temperature sensors are provided so as to be in contact with or to be inserted into the refrigerant pipe to detect the refrigerant temperature. An intake air temperature sensor 520*c* (fluid temperature detecting section) detects ambient temperature of the outdoor where the heat source-side heat exchanger 503 is installed.

There are also provided heat exchange inlet temperature sensors 525*a* and 525*b* (the refrigerant temperature detecting sections on the outlet side of the high pressure-side heat exchanger during the heating operation) on the refrigerant inlet side during the cooling operation of the load-side heat exchangers 506*a* and 506*b*, heat exchange outlet temperature sensors 524*a* and 524*b* on the outlet side and heat exchange temperature sensors 523*a* and 523*b* (the low pressure refrigerant temperature detecting section during the cooling operation and the high-pressure refrigerant temperature detecting section during the heating operation) for detecting evaporating temperature of the refrigerant two-phase portion during the cooling operation. An intake temperature sensor 522 is provided on the inlet side of the compressor 501. Indoor intake air temperature sensors 520*a* and 520*b* (fluid temperature detecting section) detect ambient temperature of the indoor where the load-side heat exchangers 506*a* and 506*b* are installed.

A pressure sensor (pressure detecting section) 516*a* is provided on the discharge side of the compressor 501 and a pressure sensor 516*b* is provided on the intake side of the compressor 501, respectively. It becomes possible to detect refrigerant super-heating degree at the inlet of the accumulator by providing a pressure sensor and a temperature sensor at the position of the pressure sensor 516*b* and the intake temperature sensor 522. Here, the temperature sensor is positioned on the inlet side of the accumulator to control the refrigerant super-heating degree at the inlet of the accumulator and to realize an operation by which the liquid refrigerant does not return to the accumulator (described later in detail). It is noted that the position of the pressure sensor 516*b* is not limited to the position shown in the figure and it may be provided at any position in the section from the four-way valve 502 to the intake side of the compressor 501. Furthermore, it is possible to find the condensation temperature of the refrigerating cycle by converting the pressure of the pressure sensor 516*a* to saturation temperature.

Each value detected by each temperature sensor is inputted to the measuring section 101 and is processed by the computing section 102. Based on the result of the computing section 102, the control section 103 carries out a control to fall within desired control target ranges by controlling the compressor 501, the four-way valve 502, the fans 510*a*, 510*b* and 510*c*, the pressure regulating valves 505*a*, 505*b*, 505*c* and 505*d* and the electromagnetic valves 515*a*, 515*b* and 515*c*. The storage section 104 stores the result obtained by the computing section 102 and constants set in advance and the comparing section 105 compares the stored values with values of the present refrigerating cycle state. The judging section 106 judges a refrigerant filling state of the air conditioner from the comparison result and the announcing section 107 announces the judged result to an LED (light Emitting Diode), a distant monitor and the like. Here, the computing section 102, the storage section 104, the comparing section 105 and the judging section 106 are called as the computation judging section 108 altogether.

It is noted that the measuring section 101, the control section 103 and the computation judging section 108 may be composed of a microcomputer or a personal computer.

Furthermore, the control section 103 is connected with the respective devices within the refrigerating cycle as shown by chain lines through wires or by wireless to control the respective devices appropriately.

Next, a refrigerant filling amount judging algorithm of the computation judging section 108 implemented in judging an adequate refrigerant filling amount of the air conditioner described above will be explained.

The parameter $A_L$ % denoting the condenser liquid phase area ratio that is the index in judging the refrigerant filling amount in the case when the refrigerant is reserved in the condenser can be expressed by the expressions (7) or (8) described above.

Next, a method for setting a threshold value that becomes an object of comparison in judging the adequate refrigerant filling amount by $A_L$ % will be explained. Generally, in an air conditioner in which a number of units may be connected on the load side, a content volume of the heat source-side unit is larger than a total content volume of heat exchangers that can be connected on the load side. Furthermore, when the condenser is compared with the evaporator, while an existing refrigerant amount is small in the evaporator because gas or two-phase refrigerant with small density collects in the evaporator, an existing refrigerant amount becomes large in the condenser because two-phase refrigerant and liquid refrigerant with large density collect in the condenser (the density of the liquid refrigerant is larger than the density of gaseous refrigerant by 10 to 30 times). Therefore, a required refrigerant amount of the air conditioner system becomes larger in the cooling operation in which the heat source-side heat exchanger 503 with a large volume becomes the condenser than that in the heating operation.

Accordingly, the refrigerant amount of the air conditioner is set on the basis of the cooling operation and it is a general practice to operate while collecting the extra refrigerant in the heating operation to the liquid reservoir such as the accumulator.

Figure 11:
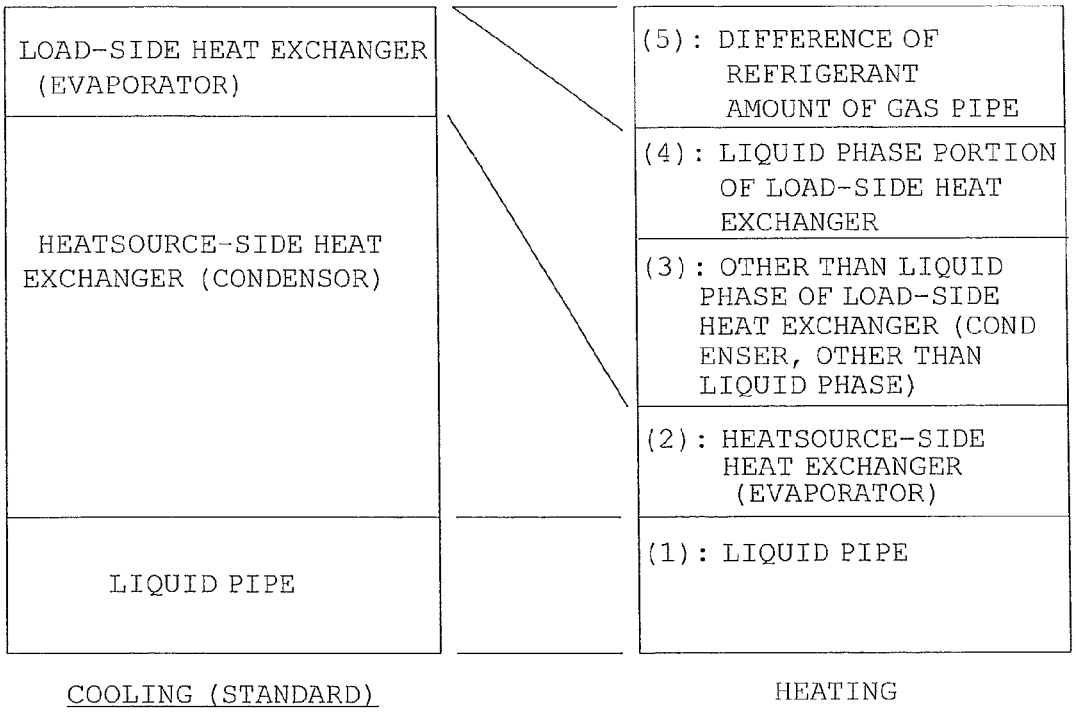
FIG. 11 is a chart for comparing distribution of refrigerant amount in refrigerating cycles during cooling and heating operation of the air conditioner.

FIG. 11 shows a distribution of refrigerant amount (mass) in the air conditioner system during the cooling operation and heating operation. FIG. 11 shows a difference of the refrigerant amounts during the cooling operation and heating operation in a gas pipe only on the heating side.

When the refrigerant amounts during the cooling operation and heating operation are compared as shown in FIG. 11, there is no difference in the liquid pipe of (1). in the gas pipe of (5), the refrigerant amount in the gas pipe becomes large during the heating operation because the gas pipe becomes the low pressure side during the cooling operation and becomes the high-pressure side during the heating operation and the gas density increases about 5 times during the heating operation. In the heat source-side heat exchanger of (2), while the liquid refrigerant exists and the refrigerant amount is large because the heat source-side heat exchanger becomes the condenser and carries out the super-cooling operation during the cooling operation, it becomes the evaporator in the heating operation, so that the refrigerant amount decreases. The refrigerant amount of the load-side heat exchanger is small because it becomes the evaporator in the cooling operation. However, the refrigerant amount increases in the heating operation because it becomes the condenser and the super-cooling liquid refrigerant exists. It is noted that the load-side heat exchanger during the heating operation is shown by dividing into portions, other than the liquid phase portion of (3) (gaseous or two phase) and the liquid phase portion (4).

The invention carries out an operation of emptying the liquid reservoir such as the accumulator in judging the refrigerant filling amount and of collecting the whole liquid refrigerant in the cycle into the condenser and the liquid pipe (described later in detail). Therefore, the extra refrigerant during the heating operation is collected into the load-side heat exchanger that is the condenser and appears as the refrigerant amount in the liquid phase portion (4) of the load-side heat exchanger. Therefore, it becomes possible to judge the refrigerant amount accurately also in the heating operation by predicting the refrigerant amount in the liquid phase portion of the load-side heat exchanger and by setting $A_L$ % corresponding to that as a threshold value.

Next, a method for setting the $A_L$ % threshold value during the heating operation will be explained. The recommended refrigerant amount during the cooling operation is defined for the both heat source-side unit and load-side unit by tests and simulations per type and capacity, they may be expressed by the following expression. These refrigerant amounts may be cited from a service manual:

$$\text{cooling refrigerant amount: } M\text{cool}=\text{heat source-side unit reference refrigerant amount}+\text{load-side unit reference refrigerant amount} \quad (16)$$

It is noted that the reference refrigerant amounts of the heat source-side unit and load-side unit are different depending on air conditioning capacity of the units and values corresponding to the respective capacities are used.

A heat exchanger refrigerant amount in a state having two-phase refrigerant with no liquid phase or only gaseous refrigerant is substantially proportional to the capacity of the heat exchanger and may be expressed as follows:

$$\text{heat exchanger refrigerant amount of only gas and two-phase}=\text{heat exchanger capacity}\times\text{coefficient} \quad (17)$$

Where the coefficient is a conversion factor of the heat exchanger capacity and the refrigerant amount and may be determined by tests and simulations. Accordingly, the refrigerant amount of the heat source-side unit and the load-side unit in the state in which no liquid refrigerant collects in the condenser except of that in the extension pipe in the heating operation may be expressed as follows:

$$\text{heating refrigerant amount: } M\text{hot}=\beta\times\Sigma Q_{jo}+\alpha\times\Sigma Q_{ji} \quad (18)$$

(the refrigerant amount when heating SC=0)

where, $\Sigma Q_j$ is a total capacity of connected units (subscript o: heat source side, i: load side)

α: conversion factor of load side refrigerant amount, β: conversion factor of heat source side refrigerant amount (α and β are factors when the refrigerant within the heat exchanger is two-phase or is gaseous (when there exists no liquid))

Thereby, the refrigerant amount ΔMhot of the liquid phase portion of the load-side heat exchanger of (4) shown in FIG. 11 on the load-side unit that becomes the condenser during the heating operation may be expressed as follows:

$$\Delta M\text{hot}=M\text{cool}-(M\text{hot}+\Delta M p\text{gas})[\text{kg}] \quad (19)$$

where, ΔMpgas is the difference of refrigerant amount in the gas pipe of (5) shown in FIG. 11.

ΔMpgas is a typical length of the refrigerant pipe and is decided to be 70 m. It is noted that because ΔMpgas is gas refrigerant amount, its ratio to the whole amount is as small as several % and is not so influential to a filling error of the refrigerant amount even if the length of the extension pipe differs from its design in an actual machine.

Next, changes of the $A_L$ % at the time when the liquid refrigerant collects in the heat exchanger will be explained by using FIG. 12.

Figure 12:
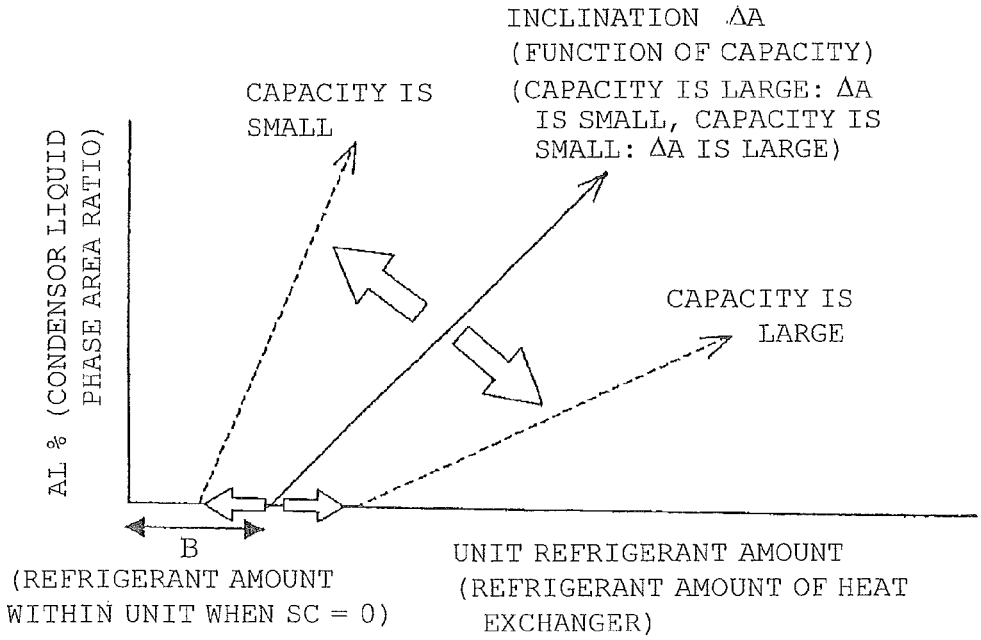
FIG. 12 is a relational graph of an increase of refrigerant amount and $A_L$ % in a heat exchanger of the air conditioner.

FIG. 12 is a graph in which heat exchanger refrigerant amount (≈unit refrigerant amount) is represented by an axis of abscissas and $A_L$ % is represented by an axis of ordinate. B in FIG. 12 is a refrigerant amount at the time when only two-phase or gaseous refrigerant exists within the heat exchanger (super-cooling degree SC=0). It may be handled substantially as a value fixed proportionally to the capacity of the heat exchanger because it does not change largely because of its small density even though it changes more or less by a temperature condition. An inclination ΔA indicates a rate of change of $A_L$ % to the increase of refrigerant amount at the time when the liquid refrigerant collects within the heat exchanger. When the refrigerant is added to the heat exchanger and the liquid phase portion is formed, $A_L$ % that is the liquid phase area ratio starts to increase. The larger the volume (capacity), the smaller the inclination is, and the smaller the volume, the larger the inclination becomes. That is, it indicates that the liquid phase portion area quickly increases by adding the refrigerant in the heat exchanger having small volume, so that $A_L$ % also sharply rises.

As described above, it is possible to find the target $A_L$ % if the inclination ΔA corresponding to the refrigerant amount within the heat exchanger and the heat exchanger capacity is found. Because ΔA is proportional to the heat exchanger capacity, ΔA may be determined from the heat exchanger capacity by finding the relationship of ΔA and the heat exchanger capacity in advance by tests and simulations. Thus, the target $A_L$ % threshold value in filling the refrigerant may be expressed as follows:

$$A_L\ \%\ \text{threshold value}=\Delta M\text{hot}\div(\Delta A\times\Sigma Q_j)[\%] \quad (20)$$

where, $\Sigma Q_j$ is a total capacity of the connected units.

The heat exchanging capacity (air conditioning capacity) of the heat exchanger is also proportional to the volume and the larger the heat exchanging capacity, the larger the volume is. While the $A_L$ % threshold value changes (the expression 20) corresponding to the heat exchanging capacity of the load-side heat exchanger during the heating operation, the smaller the volume of the heat exchanger, the larger the $A_L$ % threshold value becomes and the larger the volume of the heat exchanger, the smaller the value becomes. That is because a large portion of refrigerant must be reserved in the heat exchanger when the volume is small. For example, $A_L$ % threshold value is 8 when the capacity of the load-side heat exchanger is 100% with respect to the heat source-side heat exchanger, it changes to 16 when the rate is 50%.

It is noted that while the expression (20) is the expression for calculating $A_L$ % threshold value during the heating operation, a target refrigerant amount of the cooling operation is an optimum refrigerant amount for the cooling operation, i.e., the refrigerant amount by which the operation efficient becomes the best, because it is the reference operation condition in case of cooling. The adequate refrigerant amount in the cooling operation is $A_L$ % during the cooling operation that is the target of the optimum liquid refrigerant amount in the heat source-side heat exchanger that becomes the condenser at the time when the cooling operation is carried out. The refrigerant amount at this time is around 5 in terms of $A_L$ %, so that the refrigerant filling amount is judged by setting $A_L$ %=5 as the target threshold value.

The air conditioner of the invention includes threshold value deciding means for deciding (including changing) the threshold value corresponding to the total capacity of the high pressure-side heat exchangers as described above. This threshold value deciding means may be realized by storing the processing steps described above in the storing section 104 as a program and by carrying out the processes by the computation judging section 108.

As described above, it becomes possible to predict the refrigerant filling rate accurately even in the heating operation in which the plurality of condensers having different capacities are connected and to fill the optimum refrigerant amount to the air conditioner, by individually finding $A_L$ % of the plurality of condensers, by finding an average value of $A_L$ % by calculating a weighted mean corresponding to the ratio of capacity of them and by setting the $A_L$ % threshold value corresponding to the total capacity of the condensers for the threshold value that becomes an object of comparison.

The weighted mean of $A_L$ % may be a ratio of volume other than the ratio of capacity. Furthermore, the $A_L$ % threshold value may be corrected corresponding to the length of pipe because it changes depending on the length of the pipe as shown in the expression (19). In this case, the longer the length of the pipe, the smaller the $A_L$ % threshold value becomes and the shorter the length of the pipe, the larger the $A_L$ % threshold value becomes.

Next, a flowchart in FIG. 13 in which this refrigerant filling algorithm is applied to the air conditioner will be explained. It is noted that the operation for judging the refrigerant filling amount of the air conditioner is carried out after installing the machine or in filling the refrigerant again after discharging the refrigerant once for maintenance. The refrigerant filling operation may be controlled by a control signal from the outside through a wire or by wireless.

Figure 13:
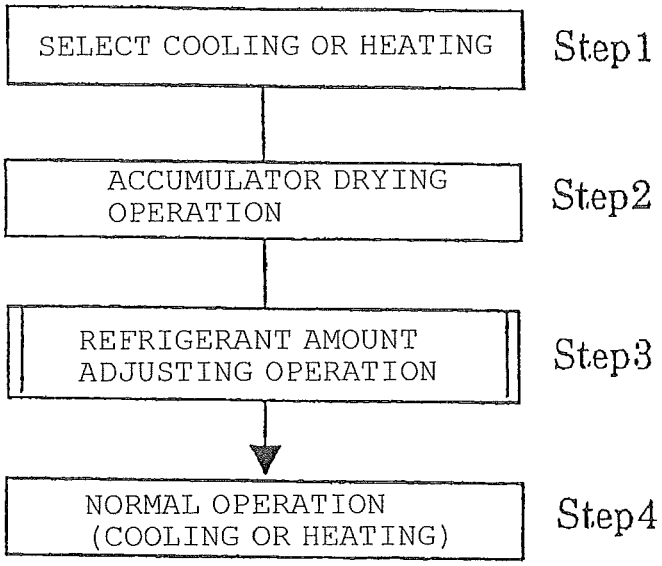
FIG. 13 is a flowchart of a refrigerant filling process of the air conditioner.

In FIG. 13, the cooling operation or heating operation of the air conditioner is selected in Step 1. This may be an operation mode desired by each user or may be a mode of automatically selecting the cooling operation at a time when the outside air temperature exceeds 15° C. for example or the heating operation at a time when the temperature is below that. It is noted that the four-way valve 502 connects the circuit by broken lines during the heating operation and by a solid line during the cooling operation as shown in FIG. 10.

Next, operations of the cooling operation and heating operation will be explained. In the heating operation, the high-temperature and high-pressure gaseous refrigerant discharged out of the compressor 501 reaches to the load-side heat exchangers 506*a* and 506*b* via the four-way valve 502 and the gas pipe 512 and the refrigerant gas is liquefied and condensed by air sent from the fans 510*a* and 510*b*. Condensation temperature at this time may be found by the temperature of the temperature sensors 523*a* and 523*b* or by converting the pressure of the pressure sensor 516*a* to the saturation temperature. The super-cooling degree SC of the load-side heat exchangers 506*a* and 506*b* serving as the condensers may be found respectively by subtracting values of the temperature sensors 525*a* and 525*b* from the condensation temperature. The condensed and liquefied refrigerant is decompressed by the pressure regulating valve 505*d* so that it becomes a two-phase state. It is noted that the pressure regulating valves 505*a* and 505*b* are fully opened here so as to put inside of the liquid pipe 511 into the liquid refrigerant state. The pressure regulating valve 505*c* is closed. Thereby, it becomes possible to carry out an operation to collect the entire liquid refrigerant within the refrigerating cycle into the condensers and the liquid pipes.

The two-phase refrigerant reaches the heat source-side heat exchanger 503. Then, the refrigerant is evaporated and gasified by the action of the blowing of the fan 510*c* and returns to the compressor 501 via the four-way valve 502 and the accumulator 508. The evaporation temperature in the heat source-side heat exchanger may be found by the temperature sensor 523*c* and intake super-cooling degree at the inlet of the accumulator may be found by a value obtained by subtracting the value of evaporation temperature obtained by converting the pressure of the pressure sensor 516*b* into the saturation temperature from the value of the intake temperature sensor 522.

In the cooling operation, the high-pressure and high-pressure gaseous refrigerant discharged out of the compressor 501 reaches the heat source-side heat exchanger 503 via the four-way valve 502 and the refrigerant gas is liquefied and condensed by air sent from the fan 510*c*. Condensation temperature at this time may be found by the temperature of the temperature sensor 523*c* or by converting the pressure of the pressure sensor 516*a* to the saturation temperature. The super-cooling degree SC of the heat source-side heat exchanger 503 serving as the condenser, may be found by subtracting a value of the temperature sensor 524*c* from the condensation temperature. The condensed and liquefied refrigerant reaches the pressure regulating valves 505*a* and 505*b* via the pressure regulating valve 505*d* whose opening angle is fully opened, the super-cooling heat exchanger 509 and the liquid pipe 511 and is decompressed so that it becomes the two-phase state. The two-phase refrigerant that has been decompressed and has become low-temperature and low-pressure in the pressure regulating valve 505*c* exchanges heat with the refrigerant in the main pipe in the super-cooling heat exchanger 509 and the liquid refrigerant on the side of the main refrigerant pipe is cooled, increasing the super-cooling degree. The refrigerant that has gone through the pressure regulating valve 505*c* is heated and gasified in the super-cooling heat exchanger 509 and returns to front side of the accumulator. It is noted the operation may be carried without using the super-cooling heat exchanging circuit by fully closing the pressure regulating valve 505*c*. The two-phase refrigerant decomposed by the pressure regulating valves 505*a* and 505*b* of the main refrigerant pipe is gasified by the action of the blowing of the fans 510*a* and 510*b* in the load-side heat exchangers 506*a* and 506*b* serving as the evaporators. The temperature sensors 506*a* and 506*b* measure the evaporation temperature at this time and super-heating degree at the outlet of the heat exchanger may be found by subtracting the values of the respective evaporation temperatures from the values of the heat exchange outlet temperature sensors 524*a* and 524*b*. Then, the gaseous refrigerant returns to the compressor 501 via the four-way valve 502 and the accumulator 508. It is possible to find the intake super-heating degree in front of the accumulator in the same manner with the case of the heating operation.

In Step 2, an accumulator drying operation is carried out. In the air conditioner having a liquid reservoir such as an accumulator as shown as this example, there is a possibility that the liquid refrigerant collects in the accumulator in the initial stage in which the refrigerating cycle after starting the compressor is non-stationary and the state of the condensation and evaporation in the heat exchanger is unstable, and its tendency is specially remarkable in the heating low temperature condition when the outside air temperature drops. In this case, although the liquid refrigerant collected in the accumulator and others is evaporated or is recovered from a small hole provided in a U shape pipe within the accumulator, it takes a lot of time to completely eliminate the liquid refrigerant. When the liquid refrigerant whose density is large exists in the accumulator and others, the distribution of refrigerant in the refrigerating cycle largely deviates and the liquid refrigerant amount within the condenser is reduced. Therefore, it becomes unable to judge the refrigerant amount accurately by the condenser liquid phase area ratio $A_L$ % that is the index for judging the refrigerant amount. Therefore, it is necessary to quickly remove the liquid refrigerant within the accumulator in order to improve workability of the installation works.

In the accumulator drying operation, the electromagnetic valve 515*b* that connects the discharge side of the compressor with the front side of the accumulator is opened so that high-temperature and high-pressure discharge gas flows directly into the accumulator. Thereby, even if a large amount of the liquid refrigerant collects into the accumulator, the liquid refrigerant may be quickly evaporated by the heat exchanging action of the high-temperature gas and the liquid refrigerant. It is noted that the operation method described above is common to the cooling operation and heating operation. The process in Step 2 is continuously carried out for 5 to 10 minutes for example and is shifted to Step 3.

A refrigerant amount adjusting operation is carried out in Step 3 to fill the refrigerant from the refrigerant cylinder 530 to the refrigerating cycle. After finishing the process in Step 3, the process shifts to Step 4. Because the adjustment of refrigerant amount is completed in Step 3, the normal cooling or heating operation can be carried out in Step 4. The detail of Step 3 will be explained by using the flowchart of the refrigerant amount adjusting operation in FIG. 4 described before.

As shown in FIG. 4, a refrigerant filling operation control of the air conditioner is carried out in Step 1. The refrigerant filling operation control is carried out so that frequency of the compressor 501 and a number of revolutions of the fans 510*a*, 510*b* and 510*c* become constant. During the cooling operation, the control section 103 controls the opening angles of the pressure regulating valves 515*a* and 515*b* so that low pressure of the refrigerating cycle falls within a predetermined control target value range set in advance to bring about a super-heating degree at the outlet of the evaporator. During the heating operation, the control section 103 controls the opening angle of the pressure regulating valve 505*d* so that the low pressure of the refrigerating cycle falls within a predetermined control target value range set in advance to bring about an intake super-heating degree at the inlet-side of the accumulator 508.

During the heating operation in a system in which a plurality of types of machines having different capacities is connected, when a pressure regulating valve corresponding to each condenser is fully opened, refrigerant flow rates are unbalanced between the respective condensers, bringing about a state in which only super-cooling degree of either heat exchanger becomes too large and no super-cooling degree is brought about to the other heat exchanger (although there is a less possibility of causing unbalance in the present embodiment because only two machines are connected, there is a high possibility of causing the unbalance when a large number of types of machines having different capacities such as 10 or more machines are connected). Even when the large number of types of machines having the different capacities are connected, it becomes possible to make the refrigerant flow with the rate corresponding to the capacity of each heat exchanger, to eliminate the unbalance of super-cooling degree, to calculate $A_L$ % accurately and to predict the refrigerant filling amount accurately, by fully opening an opening angle of a pressure regulating valve corresponding to a heat exchanger whose volume is largest and by opening the other pressure regulating valves so that their opening area becomes the same ratio with the ratio of volume of the heat exchangers. Still more, when there exists a heat exchanger to which super-cooling degree is hardly brought about particularly during the refrigerant filling operation, it becomes possible to completely eliminate the unbalance by gradually reducing an opening angle of only a pressure regulating valve of that heat exchanger to eliminate the super-cooling degree unbalance with others.

Next, operation data such as pressure and temperature of the refrigerating cycle is taken into and is measured by the measuring section 101 in Step 2. Then, the computing section 102 calculates values such as super-heating degree (SH) and super-cooling degree (SC). Then, it is judged in Step 3 whether or not the control target evaporator outlet-side super-heating degree (SH) or accumulator intake-side super-heating degree (SH) is within the target range. The target super-heating degree SH is 10±5° C. for example.

A purpose of controlling the super-heating degree within the target range is to keep the refrigerant amount on the evaporator-side constant during the control of refrigerant filling operation, by keeping the outlet operation state on the evaporator-side constant so that much liquid refrigerant whose density is large does not collect on the evaporator-side. The refrigerant other than that collects mainly in the connection pipe 511 that is an extension pipe on the liquid-side and the condenser, so that it becomes possible to detect the refrigerant filling amount by the liquid phase area ratio of the condenser.

When the super-heating degree (SH) is within the target range in Step 3, $A_L$ % is calculated next in Step 4. Although calculation with the expression (8) can not be performed when the refrigerant is extremely insufficient and the super-cooling degree (SC) is not brought about, $A_L$ % is set to be 0 in such a case. Then, it is judged whether or not $A_L$ % is equal to or more than a target value (threshold value) in Step 5. When it is judged to be equal to or more than the target value, the announcing section 107 indicates on its LED that it is an adequate refrigerant amount in Step 6.

When $A_L$ % is less than the target value in the judgment in Step 5 on the contrary, the refrigerant is filled additionally in Step 7. During the cooling operation, the electromagnetic valve 515*a* on the side of the refrigerant cylinder 530 is opened while closing the pressure regulating valve 505*c* and opening the electromagnetic valve 515*c*. Thereby, filling of the refrigerant is carried out as the refrigerant flows from the refrigerant cylinder 530 whose internal pressure is saturation pressure of the outside air temperature into the inlet side of the accumulator 508 whose pressure is lower than the saturation pressure (the refrigerant does not flow because high low pressure is applied to the check valve 517*a* in the opposite direction). The refrigerant goes through the super-cooling heat exchanger 509 where high temperature liquid refrigerant flows on its way from the refrigerant cylinder 530 to the inlet of the accumulator 508 and the refrigerant to be filled flows into the accumulator in the evaporated and gasified state, so that the liquid refrigerant will not collect in the accumulator. Accordingly, the refrigerant amount corresponding to the refrigerant filling amount is quickly reflected to the liquid phase portion of the condenser, so that sensitivity of $A_L$ % is quick and the refrigerant amount may be predicted accurately.

During the heating operation, the electromagnetic valve 515*a* on the side of the refrigerant cylinder 530 is opened while closing the pressure regulating valve 505*c* and the electromagnetic valve 515*c*. Thereby, filling of the refrigerant is carried out as the refrigerant flows from the refrigerant cylinder 530 whose internal pressure is saturation pressure of the outside air temperature into the low pressure inlet side of the evaporator at a lower evaporating temperature than that (lower than the saturation temperature of the outside air temperature by 10° C. or more) via the check valve 517*a*. The refrigerant goes through the heat source-side heat exchanger 503 whose capacity is large on its way from the refrigerant cylinder 530 to the inlet of the accumulator 508 and the refrigerant is gasified in the evaporator. Accordingly, the refrigerant amount corresponding to the refrigerant filling amount is quickly reflected to the liquid phase portion of the condenser, so that sensitivity of $A_L$ % is quick and the refrigerant amount may be predicted accurately.

An opening angle of the pressure regulating valve 505*d* may be regulated so that a temperature difference between the outside air temperature and a value of the temperature sensor 524*c* at the inlet of the evaporator during the heating operation becomes constant or so that a differential pressure of the refrigerant saturation pressure, to which the both temperatures are converted, is equalized to a constant value or more in order to keep the refrigerant flow rate filled from the refrigerant cylinder in filling the refrigerant during the heating operation at a certain value or more.

It is noted that liquid refrigerant is mixed into the refrigerant flowing into the accumulator 508 when the super-heating degree at the inlet of the accumulator is zero, so that the electromagnetic valve 515*a* is closed to stop filling the refrigerant when the super-heating degree at the inlet of the accumulator is close to zero, e.g., less than 5. Thereby, the liquid refrigerant returns to the accumulator 508 and it becomes possible to avoid such a trouble that the refrigerant filling amount cannot be judged correctly until the entire liquid refrigerant evaporates. This judgment of appropriateness of the super-heating degree is carried out in Step 3 in the flowchart in FIG. 4.

Furthermore, it is possible to judge that the refrigerant cylinder is empty when $A_L$ % does not increase after an elapse of a certain time even though the electromagnetic valve 515*a* is opened to fill the refrigerant. When it is recognized that the refrigerant cylinder is empty while filling the refrigerant, the announcing section 107 indicates that the refrigerant cylinder is empty. Then, the refrigerant cylinder is replaced to start the refrigerant filling operation again.

Still more, because either one of high-tension pressure, low-tension pressure and discharge pressure is apt to rise during the refrigerant filling operation, it is possible to judge that the refrigerant cylinder is empty when none of these pressures rises.

Thereby, it becomes possible to accurately judge the refrigerant filling amount and to fill the adequate refrigerant amount corresponding to an object machine even under any installation and environmental conditions.

Figure 16:
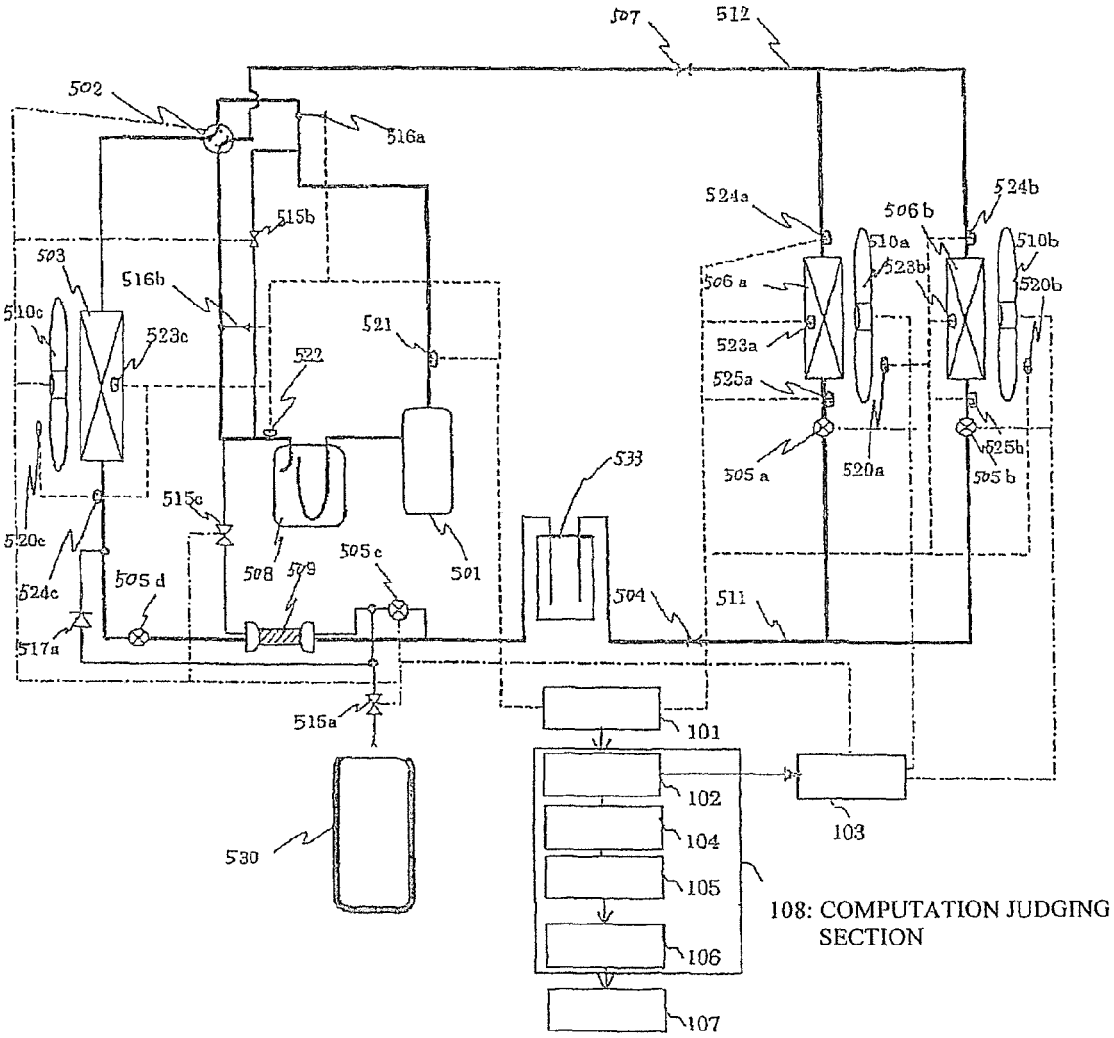
FIG. 16 is a diagram showing the structure of the air conditioner in which a receiver is added to the structure in FIG. 10.

It is noted that even in a case of the air conditioner shown in FIG. 16 in which a receiver 533 is provided between the high pressure-side heat exchanger and the low pressure-side heat exchanger of the refrigerant circuit, it becomes possible to accurately judge the refrigerant filling amount and to fill the adequate refrigerant amount corresponding to an object machine even under any installation and environmental conditions by implementing the process of moving the extra refrigerant within the receiver 533 to the high pressure-side heat exchanger and taking the steps shown in FIGS. 13 and 4.

Sixth Embodiment

Next, a sixth embodiment of the invention will be explained with reference to a drawing. The same parts with those of the fifth embodiment will be denoted by the same reference numerals and a detailed explanation thereof will be omitted here.

Figure 14:
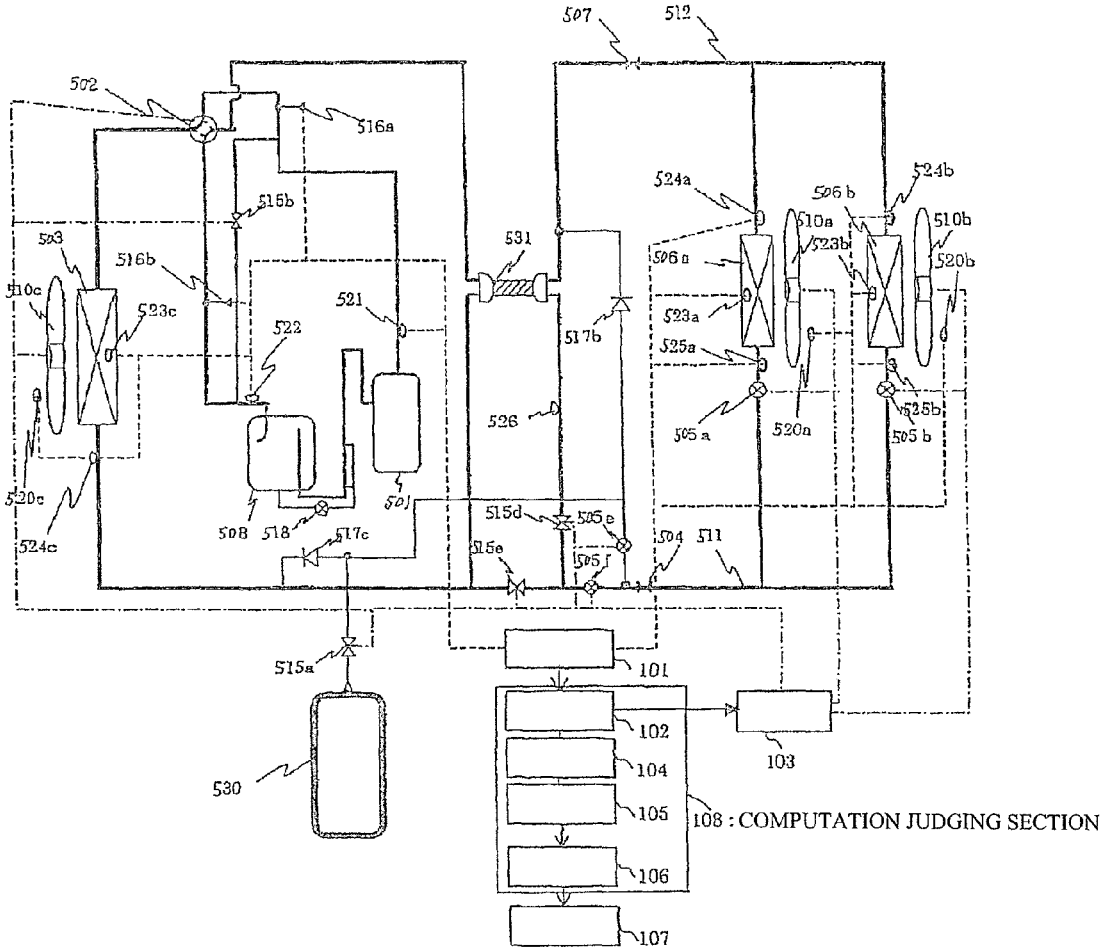
FIG. 14 is a diagram showing a structure of the air conditioner of a sixth embodiment.

FIG. 14 is a diagram showing a structure of the air conditioner of the sixth embodiment. The air conditioner in FIG. 14 has a refrigerant heat exchanger 531 for carrying out high and low pressure heat exchange and is accommodated to a pipe cleaning operation in the case of making use of the existing pipes without newly providing the gas pipe 512 and the liquid pipe 511.

In FIG. 14, a main circuit of the heat source-side unit is constructed by connecting the compressor 501, the four-way valve 502, the heat source-side heat exchanger 503, the accumulator 508, the refrigerant heat exchanger 531 and the pressure regulating valve 505*f*. The load-side unit is composed of throttle devices composed of pressure regulating valves 505*a* and 505*b* and load-side heat exchangers 506*a* and 506*b*. The heat source-side unit is connected with the load-side unit through the liquid refrigerant pipe 511, the gas refrigerant pipe 512, the liquid-side ball valve 504 and the gas-side ball valve 507. The heat source-side heat exchanger 503 is provided with the fan 510*c* for blowing air and the load-side heat exchangers 506*a* and 506*b* are also provided with fans 510*a* and 510*b*. It is noted that the refrigerant heat exchanger 531 is disposed between the heat source-side unit and the load-side unit and carries out heat exchange between the high pressure-side refrigerant and the low pressure-side refrigerant.

A primary passage (high pressure-side during the cooling operation) of the refrigerant heat exchanger 531 is provided in a main refrigerant pipe connecting the heat source-side heat exchanger 503 and the pressure regulating valve 505*f* and a bypassing electromagnetic valve 515*e* used in the normal heating operation is provided on the primary passage. A secondary passage (low pressure-side during the cooling operation) of the refrigerant heat exchanger 531 is provided between the four-way valve 502 and the gas-side ball valve 507. The refrigerant heat exchanger 531 is used for the purpose of carrying out super-cooling (similarly to the super-cooling heat exchanger 509 in the first embodiment) by exchanging heat between the high-temperature and high-pressure refrigerant discharged out of the heat source-side heat exchanger 503 and the low temperature and low pressure refrigerant during the normal cooling operation. The electromagnetic valve 515*e* is opened and the refrigerant heat exchanger 531 is not used in the normal heating operation.

In the heat source-side unit, the refrigerant cylinder 530 is connected via the electromagnetic valve 515*a* and two branched pipes. One of the branched pipe is connected between the gas-side ball valve 507 and the secondary passage of the refrigerant heat exchanger 531 and the other one is connected between the heat source-side heat exchanger 503 and the primary passage of the refrigerant heat exchanger 531. For the refrigerant cylinder 530 as the refrigerant reservoir, a refrigerant cylinder available at the installation site may be connected at the site or a reservoir may be built in the heat source-side unit. When the refrigerant reservoir is built in the heat source-side unit, the refrigerant is filled into the container that functions as the refrigerant cylinder in advance before shipping and is shipped while enclosing the refrigerant within the sealed container by closing the electromagnetic valve 515*a*. The electromagnetic valve 515*a* is not limited to be an electromagnetic valve and may be a switch valve such as a flow regulating valve, or a valve that can be manually opened/closed by the operator while watching some outside output from the air conditioner.

Although the object of heat-absorption of the condensed heat of the refrigerant in the condenser of the air conditioner described above is air, it may be water, refrigerant, brine or the like, and a supplying device of the object of heat absorption may be a pump or the like. Furthermore, although FIG. 14 shows a case where there are two load-side units, there may be plural number of units such as three or more. A capacity of the respective load-side units may also differ or may be the same. Still more, the heat source-side unit may be composed of a plurality of machines in the same manner as the fifth embodiment.

As for the sensors and the measuring control section used in the sixth embodiment, a temperature sensor 526 for calculating the super-cooling degree at the outlet of the refrigerant heat exchanger 531 during the cooling operation is provided in addition to those of the fifth embodiment.

Next, an operation of the pipe cleaning operation that is a feature of the air conditioner of the present embodiment will be explained. The air conditioner in FIG. 14 accommodates to the pipe cleaning operation in the case when the existing pipes are used for the gas pipe 512 and the liquid pipe 511. The high-temperature and high-pressure refrigerant discharged out of the compressor 501 is cooled by exchanging heat with the low pressure-side refrigerant in the refrigerant heat exchanger 531 to put into the two-phase state suitable for cleaning pipes. It becomes possible to clean the existing pipes when the refrigerant is two-phase or liquid other than gas. The gas pipe 512 may be cleaned by the two-phase refrigerant and the liquid pipe 511 may be cleaned by the refrigerant that has been cooled and become liquid by the load-side heat exchanger. It is noted that it is a known technology of cleaning and recovering foreign materials whose main component is obsolete oil such as mineral oil remaining in the existing pipe, by flowing the two-phase or liquid refrigerant within the pipe in the pipe cleaning operation.

In the pipe cleaning operation during the cooling operation, the high-temperature and high-pressure gaseous refrigerant discharged out of the compressor 501 and passed through the four-way valve 502 is condensed in the heat source-side heat exchanger 503, i.e., the condenser to become the liquid refrigerant, and flows through the liquid pipe 511. At this time, the electromagnetic valve 515*e* is closed to make the liquid refrigerant flow into the refrigerant heat exchanger 531 and the pressure regulating valve 505*f* is fully opened. The liquid refrigerant that has passed the liquid pipe 511 is decompressed by the pressure regulating valves 505*a* and 505*b* and flows through the load-side heat exchangers 506*a* and 506*b* and the gas pipe 512 in the two-phase state. Then, it exchanges heat with the high pressure-side liquid refrigerant in the refrigerant heat exchanger 531. The refrigerant becomes the gas state and returns to the compressor 501 via the accumulator 508. It is noted that the opening angle of the pressure regulating valves 505*a* and 505*b* is controlled by the control section 103 so that the super-heating degree of the inlet of the accumulator 508 keeps a plus range (e.g., around 10° C.). In the present embodiment, because the two-phase refrigerant is heated and gasified by the refrigerant heat exchanger 531 that is not included in a normal air conditioner, it becomes possible to make the two-phase refrigerant flow within the gas pipe 512 and to clean the gas pipe 512, in the cooling operation.

Next, a refrigerant filling method in the air conditioner in FIG. 14 will be explained. While the flow of the refrigerant in filling the refrigerant in the cooling operation is substantially the same as the pipe cleaning operation during the cooling operation described above, the control of the pressure regulating valves 505*a* and 505*b* is different and the control section 103 controls so that the outlet super-heating degree of the load-side heat exchangers 506*a* and 506*b*, i.e., the evaporators, falls within a target range (for example 10° C.±5° C.). Thereby, the refrigerant within the gas pipe 512 may be gasified in the same manner as the normal cooling operation. It also becomes possible to collect the liquid refrigerant within the heat source-side heat exchanger 503, i.e., the condenser, and the liquid pipe 511 and to apply the method explained in the fifth embodiment of estimating the refrigerant filling amount by the condenser liquid phase area ratio $A_L$ %.

When the electromagnetic valve 515*a* connected to the refrigerant cylinder 530 is opened in the refrigerant filling operation in the cooling operation, the refrigerant flows into the secondary inlet of the refrigerant heat exchanger 531 on the low pressure side via the check valve 517*b*. The refrigerant flowing into the secondary inlet of the refrigerant heat exchanger 531 exchanges heat with the high-temperature and high-pressure refrigerant on the high pressure side in the refrigerant heat exchanger 531 and is gasified. Therefore, the liquid refrigerant will not flow into the accumulator 508 and it becomes possible to avoid such a trouble that the liquid refrigerant collects within the accumulator and the refrigerant amount of the whole machine cannot be accurately grasped. It is noted that because the inner pressure of the refrigerant cylinder 530 corresponds to the saturation pressure of the outside air temperature and is higher than the secondary inlet of the refrigerant heat exchanger 531, the refrigerant flows in the normal direction into the main refrigerant circuit via the check valve 517*b*. Furthermore, the refrigerant does not flow because the check valve 517*c* is pressed in the opposite direction at this time and the pressure regulating valve 505*e* is closed.

A flow of the refrigerant in the refrigerant filling operation in the heating operation is different from the flow of the refrigerant in the pipe cleaning operation in the heating operation described before and its circuit is constructed without going through the refrigerant heat exchanger 531. That is, the refrigerant discharged out of the compressor 501 flows through the four-way valve 502 and the gas pipe 512 in the high-temperature and high-pressure gas state and is condensed and liquefied in the load-side heat exchangers 506*a* and 506*b*. The pressure regulating valves 505*a* and 505*b* are fully opened or opened corresponding to the capacity ratio as explained in the fifth embodiment in the case when a large number of load-side heat exchangers are connected. Then, the liquid refrigerant passes through the liquid pipe 511 and is decompressed by the pressure regulating valve 505*f*, becoming the two-phase refrigerant. The two-phase refrigerant is evaporated and gasified in the heat source-side heat exchanger 503 and returns to the compressor 501 via the accumulator 508.

When the electromagnetic valve 515*a* connected to the refrigerant cylinder 530 is opened in the refrigerant filling operation in the heating operation, the refrigerant flows into the inlet side of the heat source-side heat exchanger 503 on the low pressure side via the check valve 517*b*. The refrigerant flowing into the heat source-side heat exchanger 503 is evaporated and gasified, so that no such trouble that the liquid refrigerant flows into the accumulator occurs. At this time, because the inner pressure of the refrigerant cylinder 530 corresponds to the saturation pressure of the outside air temperature and the heat source-side heat exchanger 503 operates as an evaporator by exchanging heat with the outside air, the refrigerant flows into the inlet of the heat source-side heat exchanger 503 whose pressure is lower than the outside air saturation pressure. Furthermore, the refrigerant does not flow through the check valve 517C and the check valve 517C because the check valve 517*c* is pressed in the opposite direction and the pressure regulating valve 505*e* is closed.

It is noted that the refrigerant filling operation steps and the method for judging the refrigerant filling amount other than those explained above are the same as the fifth embodiment.

In the air conditioner in FIG. 14, an appropriate operation assuring the refrigerant amount necessary for the pipe cleaning and the normal cooling and heating operations is made possible by initially carrying out the refrigerant filling operation after installing the machines and by carrying out the pipe cleaning operation after the refrigerant amount becomes appropriate. It is noted that because the refrigerant amount of the pipe cleaning operation may be less than that of the normal operation, it is possible to carry out the adjustment of the refrigerant amount in two steps (first adjustment of refrigerant amount: Step 1, and second adjustment of refrigerant amount: Step 3), so that the threshold value in judging the refrigerant amount is set to be lower than the $A_L$ % threshold value during the normal operation, in the adjustment of refrigerant amount before cleaning the pipe (first refrigerant filling operation: Step 1), and after ending the pipe cleaning operation (Step 2), the adjustment of the refrigerant amount (second refrigerant filling operation: Step 3) is carried out so that the refrigerant amount necessary for the normal operation is filled. Thereby, during the installation works, it becomes possible to shorten an operation time before the pipe cleaning operation in Step 2 in which the air conditioning ability is smaller than a rated ability, even though the cooling and heating operations can be made, and to quickly shift to the normal air conditioning operation in which the air conditioning ability is high.

Figure 15:
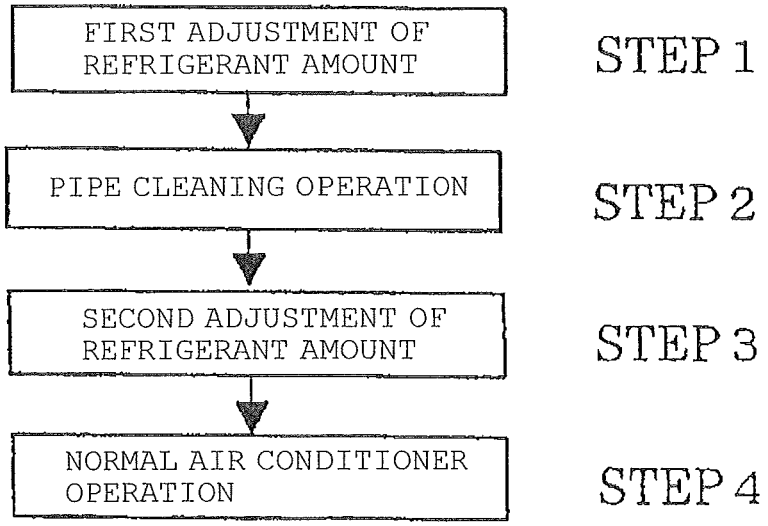
FIG. 15 is a flowchart showing a refrigerant filling and pipe cleaning process of the air conditioner of the sixth embodiment.

Still more, in case of a charge-less type air conditioner in which a refrigerant amount for a specified length of pipe (70 m for example) is charged into an extra refrigerant reserving container that becomes some refrigerant reserving means such as an accumulator, a middle pressure receiver and a high pressure receiver of the heat source-side unit. In case of a charge-less type air conditioner that requires no additional refrigerant to be filled if the length of the pipe is within the specified length, the threshold value $A_L$ % for judging the refrigerant amount in the first adjustment of refrigerant amount (Step 1) in FIG. 15 may be set as a value in which the refrigerant amount of the specified length of the pipe is taken into account. Then, when $A_L$ % of the actual machine exceeds the threshold value and the length of the pipe is judged to fall within the range accommodated by the charge-less air conditioner in Step 1, it is judged that no additional refrigerant needs to be filled and the second adjustment of refrigerant amount in Step 3 may be cut. These receivers are positioned between the high pressure-side heat exchanger and the low pressure-side heat exchanger for example.

It is noted that in the air conditioner in FIG. 14, the foreign material recovered in cleaning the existing pipe is recovered to the accumulator 508. It is possible to separate and recover the foreign material from the main refrigerant circuit by discharging the foreign material recovered to the accumulator 508 from a bottom of the accumulator.

As described above, it becomes possible to provide the air conditioner that can achieve the both of the automatic refrigerant filling control and the cleaning of the existing pipe by constructing the air conditioner as shown in FIG. 14.

The invention claimed is:

1. An air conditioner, comprising:

a heat source-side unit having a compressor, a heat source-side heat exchanger, a first throttle device and a supercooling heat exchanger;

a load-side unit having a second throttle device and a load-side heat exchanger;

a switching device for switching connections of discharge and intake sides of the compressor between the heat source-side unit and the load-side unit;

a refrigerant cylinder filled with refrigerant and connected to a refrigerating cycle of the air conditioner between the first throttle device of the heat source-side unit and the heat source-side heat exchanger through a refrigerant filling switch valve; and a controller for controlling the switching device, the first throttle device, the second throttle device and the refrigerant filling switch valve, wherein the controller calculates a liquid phase area ratio that is a heat transfer area of a liquid phase divided by a heat transfer area of the load-side heat exchanger functioning as a condenser, and controls switching of the refrigerant filling switch valve based on the calculated liquid phase area ratio.

2. The air conditioner according to claim 1, wherein the controller detects that the refrigerant in the refrigerant cylinder is empty based on changes of the liquid phase area ratio and the controller announces the refrigerant cylinder is empty via an announcing section.

3. The air conditioner according to claim 2, wherein an accumulator for reserving extra refrigerant is provided on a low pressure-side of the refrigerating cycle, refrigerant corresponding to a length of a specified extension pipe is filled in advance, and refrigerant is not required to be additionally filled when the length of the specified extension pipe is within a specified range; wherein the controller is configured for controlling the first throttle device so that refrigerant flowing into the accumulator becomes gaseous refrigerant to move the extra refrigerant within the accumulator into a high pressure-side heat exchanger, the controller judging that the length of the specified extension pipe is within the specified range in a case when the calculated liquid phase area ratio exceeds a predetermined threshold value, and cuts an additional refrigerant filling process in a case when it is judged that the refrigerant is sufficient, and the additional refrigerant filling process as well as an additional judgment are carried out in a case that the refrigerant is insufficient, so that the additional refrigerant filling process and the additional judgment are repeated by the controller until the calculated liquid phase area ratio reaches the predetermined threshold value.

4. The air conditioner according to claim 1, wherein an accumulator for reserving extra refrigerant is provided on a low pressure-side of the refrigerating cycle, refrigerant corresponding to a length of a specified extension pipe is filled in advance, and refrigerant is not required to be additionally filled when the length of the specified extension pipe is within a specified range; wherein the controller is configured for controlling the first throttle device so that refrigerant flowing into the accumulator becomes gaseous refrigerant to move the extra refrigerant within the accumulator into a high pressure-side heat exchanger, the controller judging that the length of the specified extension pipe is within the specified range in a case when the calculated liquid phase area ratio exceeds a predetermined threshold value, and cuts an additional refrigerant filling process in a case when it is judged that the refrigerant is sufficient, and the additional refrigerant filling process as well as an additional judgment are carried out in a case that the refrigerant is insufficient, so that the additional refrigerant filling process and the additional judgment are repeated by the controller until the calculated liquid phase area ratio reaches the predetermined threshold value.

5. The air conditioner according to claim 1, wherein when switching the refrigerant filling switch valve to fill the refrigerant from the refrigerant cylinder, the controller performs a heating operation so that the refrigerant from the refrigerant cylinder is gasified at the heat source-side heat exchanger that functions as an evaporator.

* * * * *